US007561826B2

(12) United States Patent
Takigawa

(10) Patent No.: US 7,561,826 B2
(45) Date of Patent: Jul. 14, 2009

(54) METHOD AND APPARATUS FOR IMAGE FORMING CAPABLE OF EFFECTIVELY SUPPORTING A PROCESS CARTRIDGE

(75) Inventor: Junya Takigawa, Tokyo (JP)

(73) Assignee: Ricoh Company, Limited, Tokyo (JP)

( * ) Notice: Subject to any disclaimer, the term of this patent is extended or adjusted under 35 U.S.C. 154(b) by 162 days.

(21) Appl. No.: 11/707,063

(22) Filed: Feb. 16, 2007

(65) Prior Publication Data

US 2007/0189805 A1 Aug. 16, 2007

(30) Foreign Application Priority Data

Feb. 16, 2006 (JP) ..... 2006-039822

(51) Int. Cl.
*G03G 21/16* (2006.01)

(52) U.S. Cl. ..... 399/111; 399/117; 399/167

(58) Field of Classification Search ..... 399/113, 399/167, 159, 117, 90, 111
See application file for complete search history.

(56) References Cited

U.S. PATENT DOCUMENTS

| | | | | |
|---|---|---|---|---|
| 3,941,433 | A * | 3/1976 | Dolling et al. | 384/129 |
| 6,093,005 | A * | 7/2000 | Nakamura | 418/55.1 |
| 2001/0021320 | A1 * | 9/2001 | Murayama et al. | 399/117 |
| 2002/0025191 | A1 | 2/2002 | Kitayama | |
| 2003/0049049 | A1 * | 3/2003 | Hoshi et al. | 399/129 |
| 2004/0086300 | A1 * | 5/2004 | Kawai et al. | 399/167 |
| 2004/0176172 | A1 * | 9/2004 | Berg | 464/78 |
| 2005/0111882 | A1 * | 5/2005 | Sudo et al. | 399/222 |
| 2005/0169670 | A1 * | 8/2005 | Noh | 399/167 |
| 2006/0051131 | A1 | 3/2006 | Takigawa | |
| 2008/0138113 | A1 * | 6/2008 | Murrell et al. | 399/167 |

FOREIGN PATENT DOCUMENTS

| | | |
|---|---|---|
| EP | 1113344 A2 | 7/2001 |
| EP | 1178370 A2 | 2/2002 |

(Continued)

OTHER PUBLICATIONS

European Patent Office Search Report dated May 15, 2007, for corresponding European Patent Application No. 07102344.4-2209.

*Primary Examiner*—David M Gray
*Assistant Examiner*—Billy J Lactaoen
(74) *Attorney, Agent, or Firm*—Harness, Dickey & Pierce, P.L.C.

(57) ABSTRACT

A support device for use in an image forming apparatus includes a process cartridge and an apparatus main body. The process cartridge further includes an image carrier, at least one sub unit, and a cartridge-side fitting portion. The at least one sub unit includes a rotational member having a driven shaft. The apparatus main body further includes an apparatus-main-body-side fitting portion and a driving device. The driving device is provided with a drive shaft, and is configured to drive the rotational member. With the support device, the drive shaft is radially positioned at one support point along an axial direction thereof in the driving device before installing the process cartridge into the apparatus main body. In addition, the drive shaft is radially positioned at the one support point and a connecting point between the driven shaft and the driven shaft after installing the process cartridge into the apparatus main body.

33 Claims, 28 Drawing Sheets

FOREIGN PATENT DOCUMENTS

| | | | |
|---|---|---|---|
| EP | 1635230 | A1 | 3/2006 |
| JP | 05-341589 | | 12/1993 |
| JP | HO6-33154 | | 4/1994 |
| JP | 08-006459 | | 1/1996 |
| JP | 10-020744 | | 1/1998 |
| JP | 2001-249604 | | 9/2001 |
| JP | 2003-005475 | | 1/2003 |
| JP | 2003-345221 | | 12/2003 |
| JP | 2004-001447 | | 1/2004 |
| JP | 2004-045603 | | 2/2004 |
| JP | 2005-017758 | | 1/2005 |
| JP | 2005-076777 | | 3/2005 |
| JP | 2005-195813 | | 7/2005 |
| JP | 2005-315352 | | 11/2005 |
| JP | 2006-078804 | | 3/2006 |

* cited by examiner

METHOD AND APPARATUS FOR IMAGE FORMING CAPABLE OF EFFECTIVELY SUPPORTING A PROCESS CARTRIDGE

PRIORITY STATEMENT

The present patent application claims priority under 35 U.S.C. §119 upon Japanese patent applications, No. JP2006-039822 filed on Feb. 16, 2006; No. JP2006-076463 filed on Mar. 20, 2006; and No. JP2006-250306 filed on Sep. 15, 2006 in the Japan Patent Office, the entire contents of each of which are incorporated by referrence herein.

BACKGROUND

Image forming apparatuses include copiers, printers, facsimiles, multi-function devices thereof, etc. Some image forming apparatuses form a color image on a recording member according to an electrophotographic method. Such an image forming apparatus employing an electrophotographic method includes an image carrier, a charger, an optical writing unit, a developer, and a cleaner.

The image carrier is configured to be a drum shaped or belt shaped photoconductor. On starting an image forming operation, the photoconductor is rotated, and a surface of the photoconductor is charged with the charger. Then, the optical writing unit emits light to form an electrostatic latent image on the surface of the photoconductor. The electrostatic latent image is visualized with toner in the developer.

Further, the resultant toner image is directly transferred onto a recording medium, such as a paper sheet, an OHP film, etc. Alternatively, the resultant toner image is indirectly transferred onto the recording medium via an intermediate transfer belt. Thus, a desired color image is formed on the recording medium.

Such an image forming apparatus may include a process cartridge that is integrally formed with the photoconductor and at least one unit from among the developer, the cleaner, the charger, etc. The process cartridge is configured to be detachably mounted on the main body of the image forming apparatus in order to downsize the image forming apparatus and obtain a high operability in maintenance operation thereof.

In the process cartridge, the developer, the cleaner, or the charger may be configured as a sub unit thereof. In this case, the sub unit is detachably mounted on the process cartridge at a position proximate the photoconductor. Then, the process cartridge including the sub unit is installed in the main body of the image forming apparatus. Thus, a drive force of a driving device provided in the main body of the image forming apparatus is transmitted so as to drive the process cartridge.

Specifically, when the process cartridge is mounted on the main body of the image forming apparatus, a drive shaft of the driving device is connected to a driven shaft of a rotational member in the sub unit, such as a developing roller in the developer unit, a cleaning member in the cleaner unit, or a charging roller in the charger unit. Thus, the image carrier becomes rotatable in conjunction with the developing roller, the cleaning member, or the charging roller.

However, in the main body of the image forming apparatus or the process cartridge, accumulation of dimensional tolerances may cause a positional variation of the drive shaft or the driven shaft. Thus, a relative displacement in axial center may be caused between the drive shaft and the driven shaft.

Further, the relative displacement in axial center between the drive shaft and the driven shaft may cause a variation in rotational torque, thereby resulting in an uneven rotation. Thus, image degradation, such as uneven density or banding, may be caused.

Some image forming apparatuses are configured to have a clearance between the drive shaft provided in the main body of the image forming apparatus and the driven shaft provided in the process cartridge in order to suppress the relative displacement in axial center between the drive shaft and the driven shaft. In such image forming apparatuses, the driven shaft may be configured as a primary guide member to guide the process cartridge into the main body of the image forming apparatus at the installation thereof.

However, for such image forming apparatuses, an effective suppression is still demanded with respect to the relative displacement in axial center between the drive shaft and the driven shaft.

SUMMARY

At least one embodiment of the present specification provides a support device for use in an image forming apparatus. Such a support device includes a process cartridge detachably mounted onto an apparatus main body. The process cartridge includes the following, an image carrier rotatably supported on a support shaft, at least one sub unit disposed proximate to the image carrier and including a rotational member, the rotational member having a driven shaft via which rotation thereof is induced, and a cartridge-side fitting portion. The apparatus main body includes the following, an apparatus-main-body-side fitting portion to cooperate with the cartridge-side fitting portion, and a driving device having a drive shaft to rotate the driven shaft of the rotational member. Wherein the support shaft of the image carrier and the cartridge-side fitting portion locate the process cartridge on the apparatus main body so as to be detachably mounted thereon. And wherein, in the driving device, the drive shaft is supported for radial adjustment at one support point along an axial direction thereof.

Additional features and advantages of the present invention will be more fully apparent from the following detailed description of example embodiments, the accompanying drawings and the associated claims.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF EXAMPLE EMBODIMENTS

Figure 1:
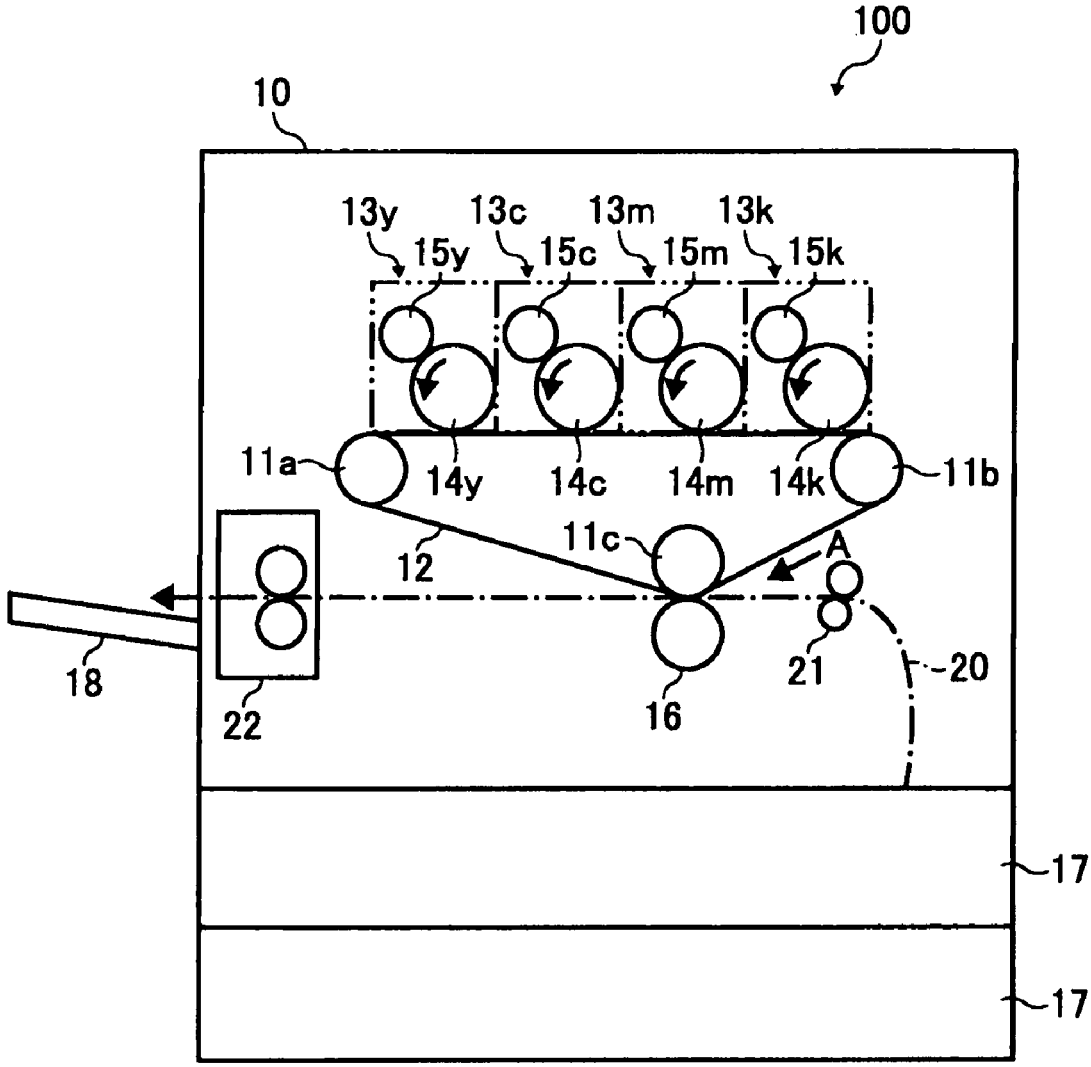
FIG. 1 is a schematic diagram illustrating a configuration of an image forming apparatus according to at least one example embodiment of the present invention.

It will be understood that if an element or layer is referred to as being "on", "against", "connected to" or "coupled to" another element or layer, then it can be directly on, against, connected or coupled to the other element or layer, or intervening elements or layers may be present. In contrast, if an element is referred to as being "directly on", "directly connected to" or "directly coupled to" another element or layer, then there are no intervening elements or layers present. Like numbers referred to like elements throughout. As used herein, the term "and/or" includes any and all combinations of one or more of the associated listed items.

Spatially relative terms, such as "beneath", "below", "lower", "above", "upper" and the like may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors herein interpreted accordingly.

Although the terms first, second, etc. may be used herein to describe various elements, components, regions, layers and/or sections, it should be understood that these elements, components, regions, layer and/or sections should not be limited by these terms. These terms are used only to distinguish one element, component, region, layer or section from another region, layer or section. Thus, a first element, component, region, layer or section discussed below could be termed a second element, component, region, layer or section without departing from the teachings of the present invention.

The terminology used herein is for the purpose of describing particular embodiments only and is not intended to be limiting of the present invention. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing example embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner.

Referring now to the drawings, wherein like reference numerals designate identical or corresponding parts throughout the several views, example embodiments of the present patent invention are described.

FIG. 1 is a schematic diagram of an image forming apparatus 100 according to at least one example embodiment of the present invention is described.

As illustrated in FIG. 1, the image forming apparatus 100 includes a main body 10, support rollers 11*a*, 11*b*, and 11*c*, an intermediate transfer belt 12, imaging stations 13*y*, 13*c*, 13*m*, and 13*k*, a secondary transfer roller 16, a recording medium cassette 17, an output tray 18, a recording-medium conveyance path 20, a registration roller pair 21, and a fuser 22.

The intermediate transfer belt 12 is provided in about the middle of the main body 10 (hereinafter, "apparatus main body 10") of the image forming apparatus 100. The intermediate transfer belt 12 is formed in an endless belt shape, and is looped over the support rollers 11*a*, 11*b*, and 11*c*.

The imaging stations 13*y*, 13*c*, 13*m*, and 13*k* are arranged along a stretching portion of the intermediate transfer belt 12 between the support rollers 11*a* and 11*b*. Each of the imaging stations 13*y*, 13*c*, 13*m*, and 13*k* forms a specific color images of yellow, cyan, magenta, and black, respectively, on a recording medium.

As illustrated in FIG. 1, the imaging stations 13*y*, 13*c*, 13*m*, and 13*k* have photoconuctors 14*y*, 14*c*, 14*m*, and 14*k*, and developer units 15*y*, 15*c*, 15*m*, and 15*k*, respectively. In addition, each of the imaging stations 13*y*, 13*c*, 13*m*, and 13*k*, further includes a charger unit, a primary transfer unit, and a primary cleaner unit (all of which are not illustrated in FIG. 1).

The photoconductors 14*y*, 14*c*, 14*m*, and 14*k* are rotatably provided in the imaging stations 13*y*, 13*c*, 13*m*, and 13*k*, respectively. In FIG. 1, the photoconductors 14*y*, 14*c*, 14*m*, and 14*k* have a drum shape, although may have a belt shape. The photoconductors 14*y*, 14*c*, 14*m*, and 14*k* serve as image carriers to bear images on the surfaces thereof.

Each of the photoconductors 14*y*, 14*c*, 14*m*, and 14*k* is surrounded in turn by the charger unit, the corresponding one of the developer units 15*y*, 15*c*, 15*m*, and 15*k*, the primary transfer unit, and the primary cleaner unit along a rotation direction thereof. Incidentally, the photoconductors 14*y*, 14*c*, 14*m*, and 14*k* are in contact with the primary transfer unit via the intermediate transfer belt 12.

In addition, an optical writing unit is provided at the vicinity of the imaging stations 13*y*, 13*c*, 13*m*, and 13*k*. The optical writing unit emits light to form a latent image on each surface of the photoconductors 14*y*, 14*c*, 14*m*, and 14*k*.

The support roller 11*c* is provided so as to be opposed to the secondary transfer roller 16 via the intermediate transfer belt 12. Thus, a secondary transfer position is formed between the support roller 11*c* and the secondary transfer roller 16. Further, a secondary cleaner unit (not illustrated) is provided on the downstream side of the secondary transfer position relative to the moving direction of the intermediate transfer belt 12, as indicated by an arrow, A, in FIG. 1.

The recording medium cassette 17 is formed in two-tiered structure at the lower part of the apparatus main body 10. The output tray 18 is detachably mounted to the apparatus main body 10.

The recording medium conveyance path 20 is provided from the recording medium cassette 17 to the output tray 18 via the secondary transfer position. The registration roller 21 and the fuser 22 are disposed along the recording medium conveyance path 20.

On starting an image forming operation, first, appropriate one of the imaging stations 13*y*, 13*c*, 13*m*, and 13*k* is selected in accordance with the image. For example, when the imaging station 13*y* is selected, the photoconductor 14*y* is rotationally driven, while the surface of the photoconductor 14*y* is uniformly charged with the charger unit. Then, the optical writing unit emits light to form an electrostatic latent image on the surface of the photoconductor 14*y*.

Further, the developer unit 15*y* visualizes the electrostatic latent image with a color toner to form a single-color toner image on the surface of the photoconductor. The single-color toner image formed on the surface of the photoconductor is transferred onto the intermediate transfer belt 12 with the primary transfer unit.

Then, when the single-color toner image is formed in only one of the imaging stations 13*y*, 13*c*, 13*m*, and 13*k*, the single-color toner image is formed on the intermediate transfer belt 12 through the primary transfer process.

Alternatively, when the single-color toner images are formed in a plurality of ones from among the imaging stations 13*y*, 13*c*, 13*m*, and 13*k*, the single-color toner images are superimposingly transferred onto the intermediate transfer belt 12. Thus, a composite color toner image is formed on the intermediate transfer belt 12 through the primary transfer process.

Meanwhile, a recording medium is picked up from the recording medium cassette 17 and is sent into the recording-medium conveyance path 20. Further, the recording medium is conveyed with the registration roller 20 to the secondary transfer position just when the toner image on the intermediate transfer belt 12 is conveyed to the secondary transfer position.

At the secondary transfer position, the toner image on the intermediate transfer belt 12 is transferred onto the recording medium with the secondary transfer roller 16. Then, the recording medium having the toner image is conveyed to the fuser 22.

The toner image is fixed on the recording medium with the fuser 22, and the recording medium is output to the output tray 18.

Excess toner remaining on the photoconductors 14*y*, 14*c*, 14*m*, and 14*k* after the primary transfer process is cleaned with the corresponding primary cleaner units. Further, excess toner remaining on the secondary transfer roller 16 after the secondary transfer process is cleaned with the secondary cleaner unit.

In addition, according to the present example embodiment, in each of the imaging stations 13*y*, 13*c*, 13*m*, and 13*k*, the corresponding photoconductor 14 and the corresponding developer unit 15 are integrally assembled as a process cartridge 24 in order to downsize the apparatus main body 10 and increase operability in the maintenance operation thereof.

In each of the process cartridges 24, the corresponding developer unit 15 is positioned proximate the corresponding photoconductor 14. Each of the process cartridge 24 is also configured to be detachably mountable to the apparatus main body 10.

In addition, the developer units 15*y*, 15*c*, 15*m*, and 15*k* each includes a developing roller 25 to supply toner to the photoconductors 14*y*, 14*c*, 14*m*, and 14*k*, respectively. Each of the developer units 15*y*, 15*c*, 15*m*, and 15*k* is configured as a sub-unit of the corresponding process cartridge 24 so as to be detachably mountable thereto.

Figure 2A:
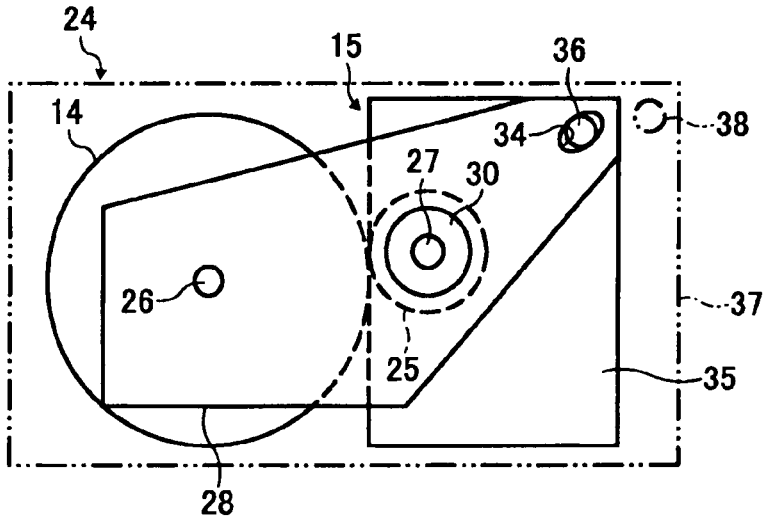
FIG. 2A is a front view illustrating (according to at least one example embodiment of the present invention) a part of a process cartridge provided in the image forming apparatus.
Figure 2B:
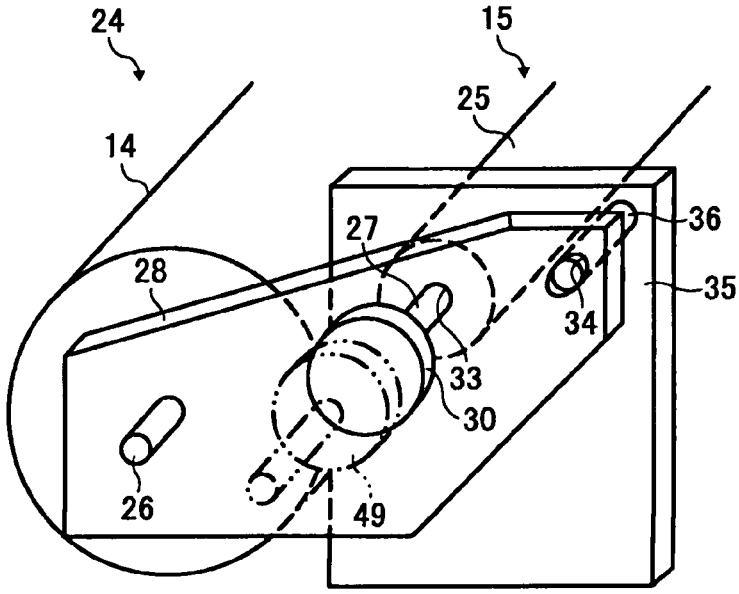
FIG. 2B is a perspective view illustrating the part of the process cartridge illustrated in FIG. 2A.

Next, referring to FIGS. 2A and 2B, a configuration of the process cartridge 24 is described.

Each of the process cartridges 24 includes a faceplate 28 and a drum shaft 26. The faceplate 28 rotatably supports a developing roller shaft 27 of the developing roller 25, which is provided at the developer 15. The faceplate 28 also serves to hold a substantially constant developing gap between the photoconductor 14 and the developing roller 25. On the other hand, the drum shaft 26 serves as a support shaft of each of the photoconductors 14*y*, 14*c*, 14*m*, and 14*k*.

According to the present example embodiment, a cartridge-side coupling 30 serving as a driven joint is fixedly provided to one end of the developing roller shaft 27.

The faceplate 28 includes a unit-side primary guide hole 33 and a unit-side secondary guide oblong hole 34. The unit-side primary guide hole 33 holds the developing roller shaft 27. The unit-side secondary guide oblong hole 34 is disposed at a distance away from the unit-side primary guide hole 33.

Then, a secondary guide pin 36 projecting from a side surface of a developer case 35 is inserted into the unit-side secondary guide oblong hole 34. Thus, the developing unit 15 is positioned as the sub-unit of the process cartridge 24 at a position proximate the photoconductor 14.

As illustrated in FIG. 2A, a cartridge-side secondary guide pin 38 is disposed on a surface of a cartridge case 37. The cartridge-side secondary guide pin 38 serves as a cartridge-side secondary guide fitting portion.

Figure 3:
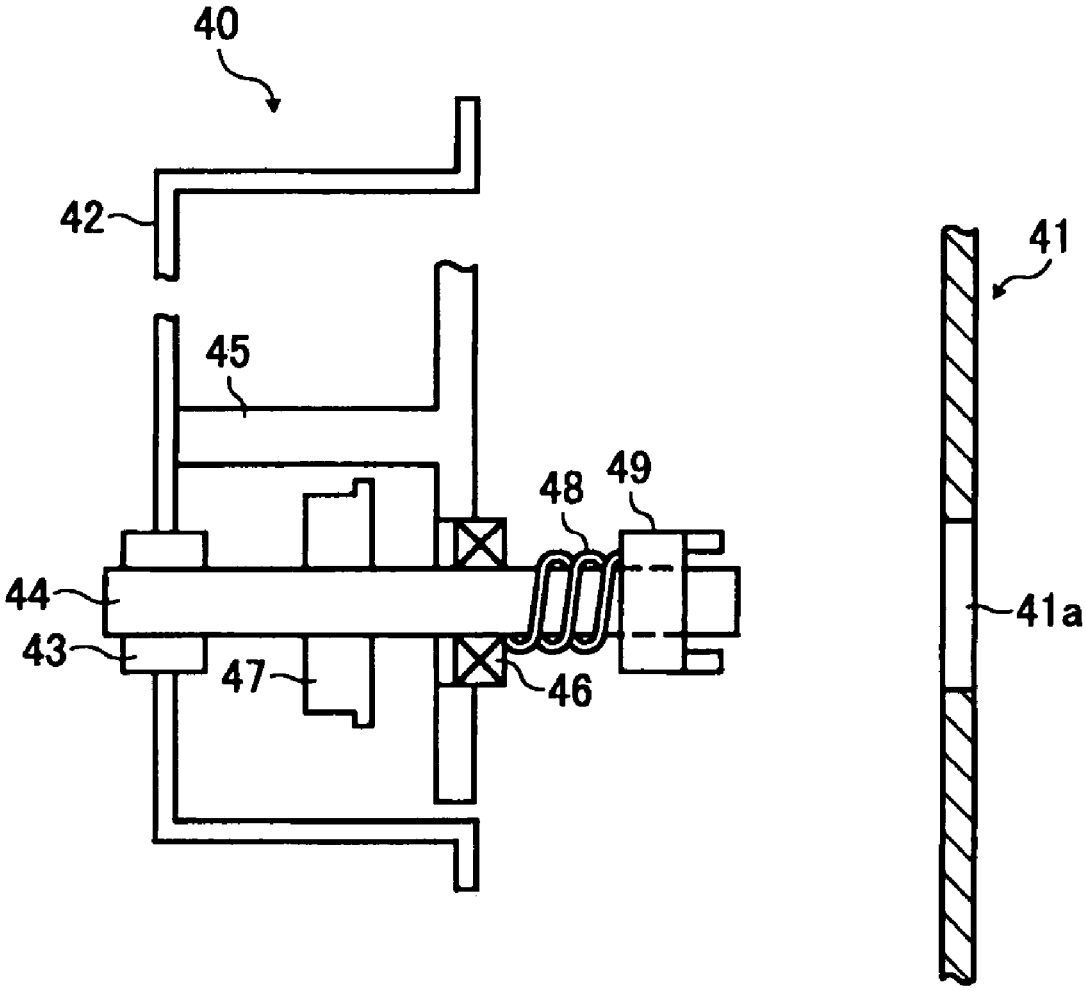
FIG. 3 is a cross-sectional view illustrating (according to at least one example embodiment of the present invention) a driving device mounted on a sideplate in a main body of the image forming apparatus.

FIG. 3 is a schematic diagram illustrating a driving device 40 provided in the apparatus main body 10 so as to drive the process cartridge 24 of FIG. 2.

As illustrated in FIG. 3, the driving device 40 includes a main-body sideplate 41, a holding plate 42, a flexible holder 43, a drive shaft 44, a supplemental support member 45, a bearing 46, a drive shaft pulley 47, a coil spring 48, and a main-body-side coupling 49.

The main-body sideplate 41 is disposed in the apparatus main body 10 so as to support various members and units. The main-body sideplate 41 has a drive-shaft support hole 41*a*.

The holding plate 42 is fixed with a screw to the main-body sideplate 41. The holding plate 42 is formed in a bracket shape so as to serve a cover part of the driving device 40.

The flexible holder 43 is disposed in the holding plate 42 so as to flexibly hold the drive shaft 44. The drive shaft 44 is rotatably supported by the flexible holder 43 and the bearing 46 with one end portion thereof projecting from the bearing 46 to the exterior of the driving device 40. The supplemental support member 45 supporting the bearing 46 is fixed with a screw to the holding plate 42.

The drive shaft pulley 47 is fixed to the drive shaft 44 at a point between the flexible holder 43 and the bearing 46. The coil spring 48 is coiled around the end portion of the drive shaft 44 projecting from the bearing 46 to the exterior of the driving device 40.

The main-body-side coupling 49 serving as a drive joint is disposed at the end portion of the drive shaft 44 projecting from the side of the bearing 46 to the exterior of the driving device 40. Thus, the main-body-side coupling 49 is configured so as to be movable along the axial direction of the drive shaft 44 by the action of the drive shaft pulley 47 and the coil spring 48. The main-body-side coupling 49 is retained with a fixing member, such as a pin, which is provided on the drive shaft 44.

Figure 6:
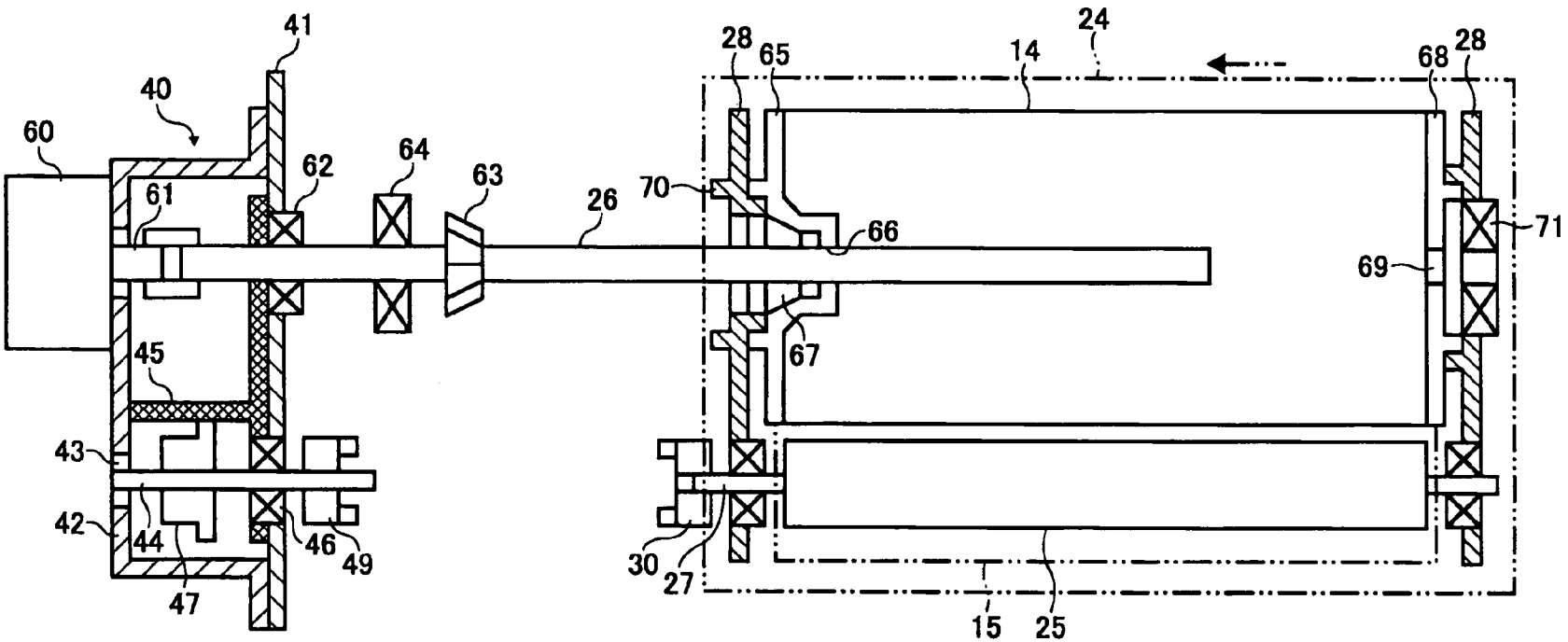
FIG. 6 is a schematic diagram illustrating (according to at least one example embodiment of the present invention) an initial state of an installation of the process cartridge to the main body of the image forming apparatus.
Figure 7A:
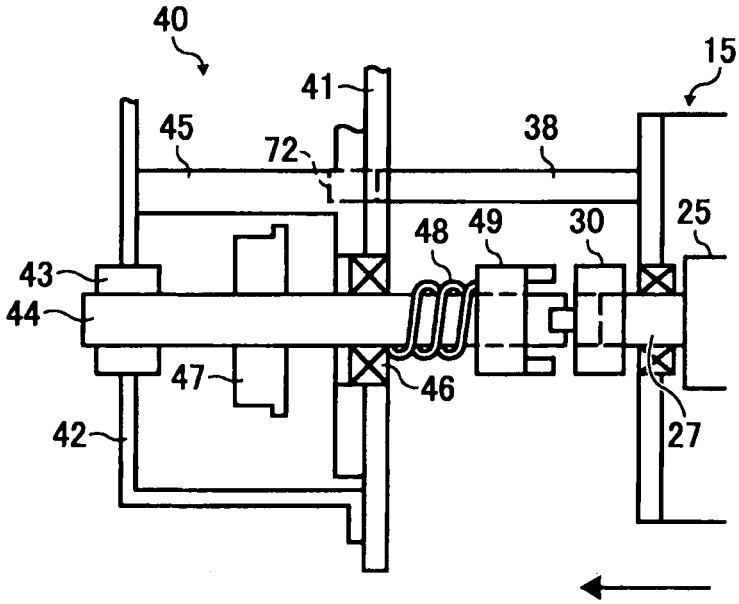
FIG. 7A is an enlarged view illustrating (according to at least one example embodiment of the present invention) a developer unit before the installation of the process cartridge to the main body of the image forming apparatus.

Further, the main-body-side coupling 49 is inserted into the drive shaft support hole 41*a* so that the drive shaft 44 is passed through the drive shaft support hole 41*a*. Thus, as illustrated in FIGS. 6 and 7A, the bearing 46 is fitted with the drive shaft support hole 41*a*. Then, the holding plate 42 is mounted on the main-body sideplate 41.

Thus, the drive shaft 44 is disposed so as to pass through the main-body sideplate 41 of the apparatus main body 10. A point at which the drive shaft 44 is passes through the main-body sideplate 41 of the apparatus main body 10 is also a support point at which the drive shaft 44 is supported by the bearing 46.

On the other hand, for the driving device 40, before installation of the process cartridge 24 into the apparatus main body 10, the drive shaft 44 is positioned with respect to the radial direction by the bearing 46 disposed at the support point along the axial direction of the drive shaft 44.

Figure 4A:
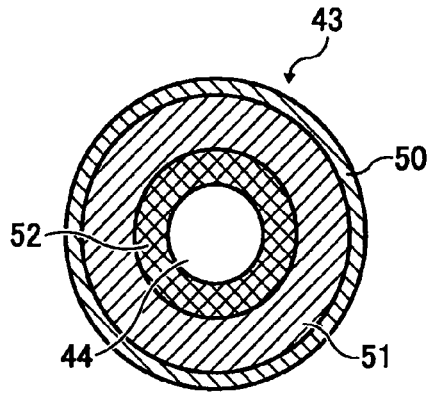
FIG. 4A is a cross-sectional view illustrating (according to at least one example embodiment of the present invention) a configuration of a flexible holder provided in the driving device.
Figure 4B:
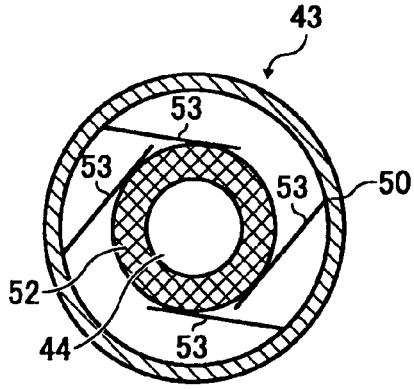
FIG. 4B is a cross-sectional view illustrating (according to at least one example embodiment of the present invention) another configuration of the flexible holder illustrated in FIG. 4A.
Figure 4C:
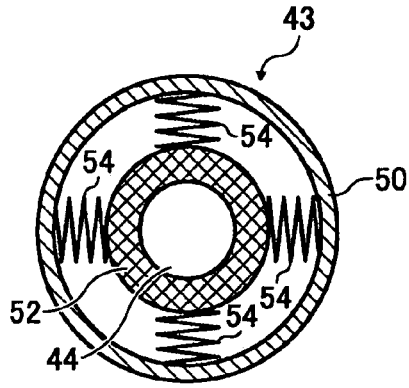
FIG. 4C is a cross-sectional view illustrating (according to at least one example embodiment of the present invention) another configuration of the flexible holder illustrated in FIG. 4A.

Next, referring to FIGS. 4A, 4B, and 4C, configuration examples of the flexible holder 43 are described.

FIG. 4A illustrates a configuration of the flexible holder 43. As illustrated in FIG. 4A, the flexible holder 43 has a holding case 50, a soft member 51, and a ball bearing 52. The ball bearing 52 is disposed in the holding case 50 so as to support the drive shaft 44. The soft member 51 is disposed between the ball bearing 52 and the holding case 50. The soft member 50 may be a gel member containing silicon rubber, a sponge material, or the like.

FIG. 4B illustrates another configuration of the flexible holder 43. The flexible holder 43 has a holding case 50, a ball bearing 52, and a plurality of plate blades 53. The ball bearing 52 is disposed in the holding case 50 so as to support the drive shaft 44. The plurality of plate blades 53 are disposed between the ball bearing 52 and the holding case 50.

FIG. 4C illustrates another configuration of the flexible holder 43. The flexible holder 43 has a holder case 50, a ball bearing 52, and a plurality of coil springs 54. The ball bearing 52 is disposed in the holder case 50 so as to support the drive shaft 44. The plurality of coil springs 54 are disposed between the ball bearing 52 and the holder case 50. Thus, the drive shaft 44 is passed through a central hole of the ball bearing 52, and is elastically held with the ball bearing 52 at the flexible holding point.

Thus, for each of the configurations illustrated in FIGS. 4A, 4B, and 4C, before the installation of the process cartridge 24 to the apparatus main body 10, the drive shaft 44 is positioned with respect to the radial direction by using the flexible holder 43 disposed at the flexible holding point and the bearing 46 disposed at the support point.

Figure 5:
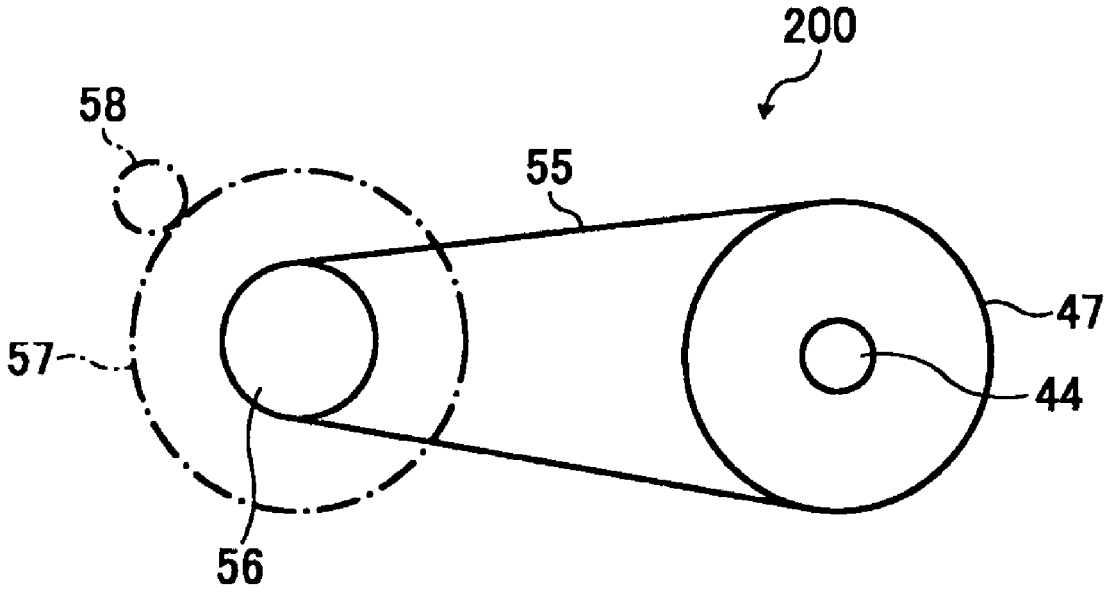
FIG. 5 is a schematic diagram illustrating (according to at least one example embodiment of the present invention) a configuration of a drive transmission mechanism to transmit a drive force of the driving device.

FIG. 5 illustrates a schematic configuration of a drive transmission mechanism 200 for the drive shaft 44.

The drive shaft pulley 47 is fixed to the drive shaft 44 and is looped over by a timing belt 55. The timing belt 55 is looped over the drive shaft pulley 47 and a drive transmission pulley 56. The drive transmission pulley 56 has a drive transmission gear 57 on an identical shaft. The drive transmission gear 57 is engaged with a drive motor gear 58 of a drive motor (not illustrated in FIG. 5). A drive force of the drive motor is transmitted to the drive shaft pulley 47 via the engagement between the drive motor gear 58 and the drive transmission gear 57, with a rotation of the timing belt 55. Thus, the drive shaft 44 is rotated.

FIG. 6 illustrates an initial state of installation of the process cartridge 24 into the apparatus main body 10.

For the driving device 40, the drive motor 60, which is not illustrated in FIGS. 3 and 5, is mounted on the holding plate 42. The motor shaft 61 of the drive motor 60 is connected in a line to the drum shaft 26. The drum shaft 26 is supported by a bearing 62 that is fitted into the main-body sideplate 41. The drum shaft 26 is also disposed so as to project through the main-body sideplate 41 to the exterior of the driving device 40. A convex gear 63 having a cone-shaped pitch surface and a bearing 64 are fixed to the drum shaft 26.

On the other hand, for the process cartridge 24, a drum shaft hole 66 is formed in a flange 65 at one end of the photoconductor 14. On an outer surface of the flange 65, a concave gear 67 having a cone-shaped pitch surface is disposed so as to center around the drum shaft hole 66. A flange 68 at the opposite end of the photoconductor 14 has a drum shaft hole 69 at a position opposed to the drum shaft hole 66.

Further, the flange 65 has one faceplate 28 thereon. An engagement frame 70 is mounted on the outer surface of the faceplate 28. On the other hand, the flange 68 also has another faceplate 28 thereon. A bearing 71 is fitted into the another faceplate 28.

When the process cartridge 24 is installed to the apparatus main body 10, the drum shaft 26 of the driving device 40 is inserted into the drum shaft hole 66 of the process cartridge 24. Further, the tip of the drum shaft 26 is inserted into the central hole of the bearing 71.

Figure 7B:
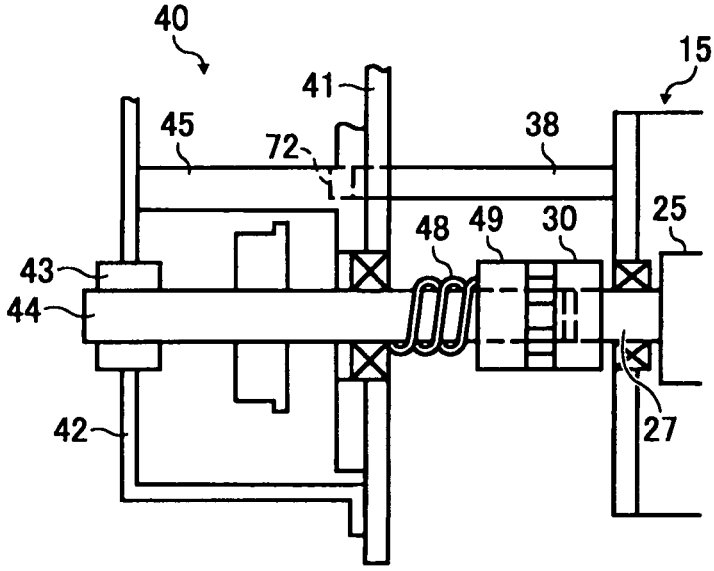
FIG. 7B is an enlarged view illustrating the developer unit of FIG. 7A after the installation.

FIGS. 7A and 7B are enlarged schematic diagrams of the developer unit 15 at the installation of the process cartridge 24 into the apparatus main body 10. FIG. 7A illustrates the developer unit 15 before the installation. On the other hand, FIG. 7B illustrates the developer unit 15 after the installation.

As illustrated in FIGS. 7A and 7B, the cartridge-side secondary guide pin 38 of FIG. 2 is mounted on the process cartridge 24 so as to serve as the cartridge-side secondary guide fitting portion. On the other hand, a main-body-side secondary guide oblong hole 72 is formed in the driving device 40 so as to serve as a main-body-side secondary guide fitting portion. Then, at the installation of the process cartridge 24 into the apparatus main body 10, the cartridge-side secondary guide pin 38 is engaged with the main-body-side secondary guide oblong hole 72.

At this time, the process cartridge 24 is installed to the apparatus main body 10 while using the drum shaft 26 as a primary guide and the cartridge-side secondary guide pin 38 as a secondary guide. Further, the convex gear 63 of FIG. 6 is engaged with the concave gear 67, and the bearing 64 is attached to the engagement frame 70. On the other hand, for the developer unit 15, the main-body-side coupling 49 is connected to the cartridge-side coupling 30 as illustrated in FIG. 7B.

Figure 8:
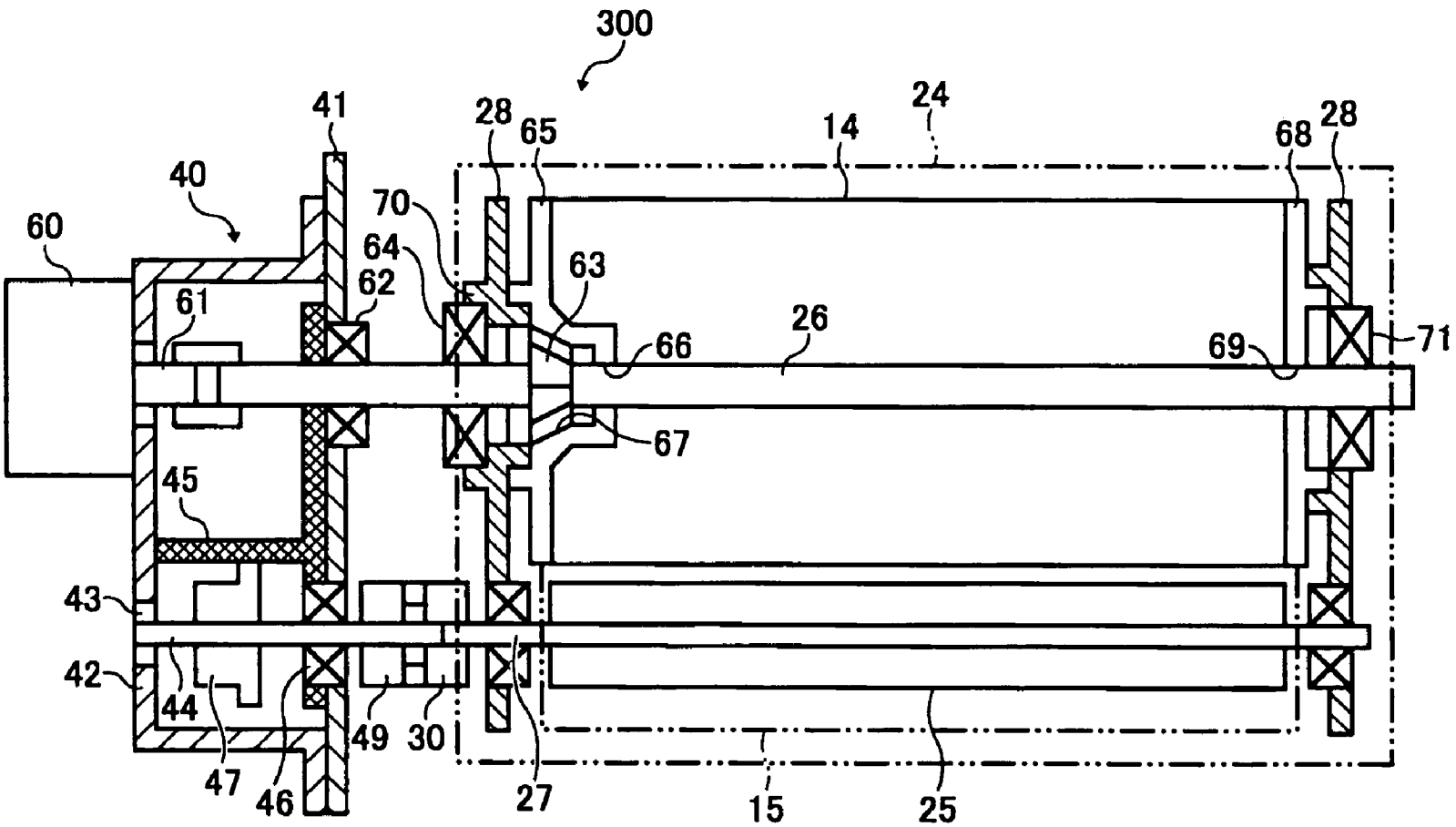
FIG. 8 is a schematic diagram illustrating (according to at least one example embodiment of the present invention) a process cartridge support device when the process cartridge is mounted to the main body of the image forming apparatus.

FIG. 8 is a schematic diagram illustrating the process cartridge support device 300 in a state where the process cartridge 24 is connected to the main-body-side coupling 49.

As illustrated in FIG. 8, after the process cartridge 24 is installed to the apparatus main body 10, the drive shaft 44 is connected to the developing roller shaft 27, which serves as a driven shaft, via the main-body-side coupling 49 and the cartridge-side coupling 30. Then, the drive shaft 44 is positioned with respect to the radian direction by the developing roller shaft 27 via the main-body-side coupling 49 and the cartridge-side coupling 30, together with the bearing 46 disposed at the support point.

Then, the drive force of the driving motor 60 is transmitted to the drum shaft 26, whereby the drum shaft 26 is rotated via the engagement between the convex gear 63 and the concave gear 67. Thus, the photoconductor 14 is rotated with the rotation of the drum shaft 26. In addition, the drive force of the drive shaft 44 of the driving device 40 is transmitted so as to rotationally drive the developing roller 25.

Figure 9A:
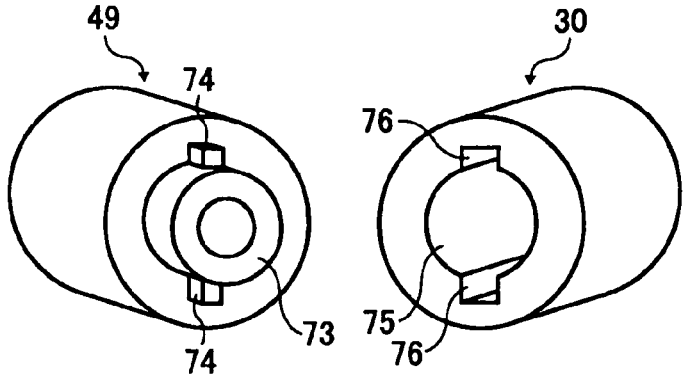
FIG. 9A a schematic diagram illustrating (according to at least one example embodiment of the present invention) configurations of a main-body-side coupling and a cartridge-side coupling.
Figure 9B:
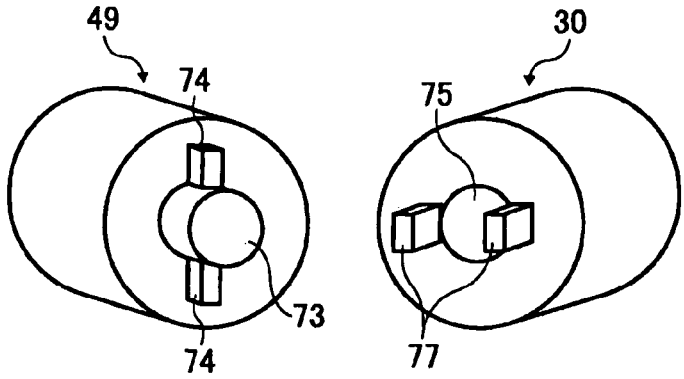
FIG. 9B a schematic diagram illustrating (according to at least one example embodiment of the present invention) another configuration of the main-body-side coupling and the cartridge-side coupling illustrated in FIG. 9A.
Figure 9C:
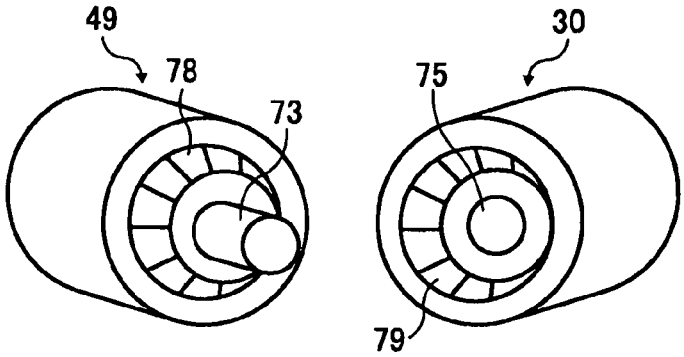
FIG. 9C a schematic diagram illustrating (according to at least one example embodiment of the present invention) another configuration of the main-body-side coupling and the cartridge-side coupling illustrated in FIG. 9A.

Next, referring to FIGS. 9A, 9B, and 9C, the shape of the main-body-side coupling 49 and the cartridge-side coupling 30 are described.

FIG. 9A illustrates an example embodiment of the main-body-side coupling 49 and the cartridge-side coupling 30. As illustrated in FIG. 9A, the main-body-side coupling 49 has a tubular fitting convex portion 73 and two engagement convex portions 74. The two engagement convex portions 74 are disposed at opposite positions to each other on an outer circumferential surface of the tubular fitting convex portion 73.

On the other hand, the cartridge-side coupling 30 has a tubular fitting concave portion 75 and two engagement concave portions 76. The two engagement concave portions 76 are disposed at opposite positions to each other on an outer circumferential surface of the tubular fitting concave portion 75.

When the process cartridge 24 is installed to the apparatus main body 10, the tubular fitting convex portion 73 is inserted into and fitted with the tubular fitting concave portion 75. Thus, the drive shaft 44 is connected to the developing roller shaft 27 so that a positional displacement of the drive shaft 44 may be suppressed with respect to the radial direction.

Furthermore, the two engagement convex portions 74 are inserted into and are engaged with the two engagement concave portions 76. Thus, the drive shaft 44 is connected to the developing roller shaft 27 so as to be capable of transmitting the rotation of the drive shaft 44 to the developing roller shaft 27.

FIG. 9B illustrates another example embodiment of the main-body-side coupling 49 and the cartridge-side coupling 30. As illustrated in FIG. 9B, the main-body-side coupling 49 has a cylindrical fitting convex portion 73 and two engagement convex portions 74. The two engagement convex portions 74 are disposed at opposite positions to each other on an outer circumferential surface of the cylindrical fitting convex portion 73.

The cartridge-side coupling 30 has a cylindrical fitting concave portion 75 and two engagement convex portions 77. The two engagement convex portions 77 are disposed at opposite positions to each other in the vicinity of the inlet of the cylindrical fitting concave portion 75.

When the process cartridge 24 is installed to the apparatus main body 10, the cylindrical fitting convex portion 73 is inserted into and is fitted with the cylindrical fitting concave portion 75. Thus, the drive shaft 44 is connected to the developing roller shaft 27 so that a positional displacement of the drive shaft 44 may be suppressed with respect to the radial direction.

Furthermore, the two engagement convex portions 74 are engaged with the two engagement convex portions 77. Thus, the drive shaft 44 is connected to the developing roller shaft 27 so as to be capable of transmitting the rotation of the drive shaft 44 to the developing roller shaft 27.

FIG. 9C illustrates another example embodiment of the main-body-side coupling 49 and the cartridge-side coupling 30. As illustrated in FIG. 9C, the main-body-side coupling 49 has a cylindrical fitting convex portion 73 and a truncated conical convex gear 78. The cartridge-side coupling 30 has a cylindrical engagement concave portion 75 and a truncated conical concave gear 79.

When the process cartridge 24 is installed to the apparatus main body 10, the cylindrical fitting convex portion 73 is inserted into and fitted with the cylindrical fitting concave portion 75. Thus, the drive shaft 44 is connected to the developing roller shaft 27 so that a positional displacement of the drive shaft 44 may be suppressed with respect to the radial direction.

Furthermore, the truncated conical convex gear 78 is engaged with the truncated conical concave gear 79. Thus, the drive shaft 44 is connected to the developing roller shaft 27 so as to be capable of transmitting the rotation of the drive shaft 44 to the developing roller shaft 27.

Figure 10:
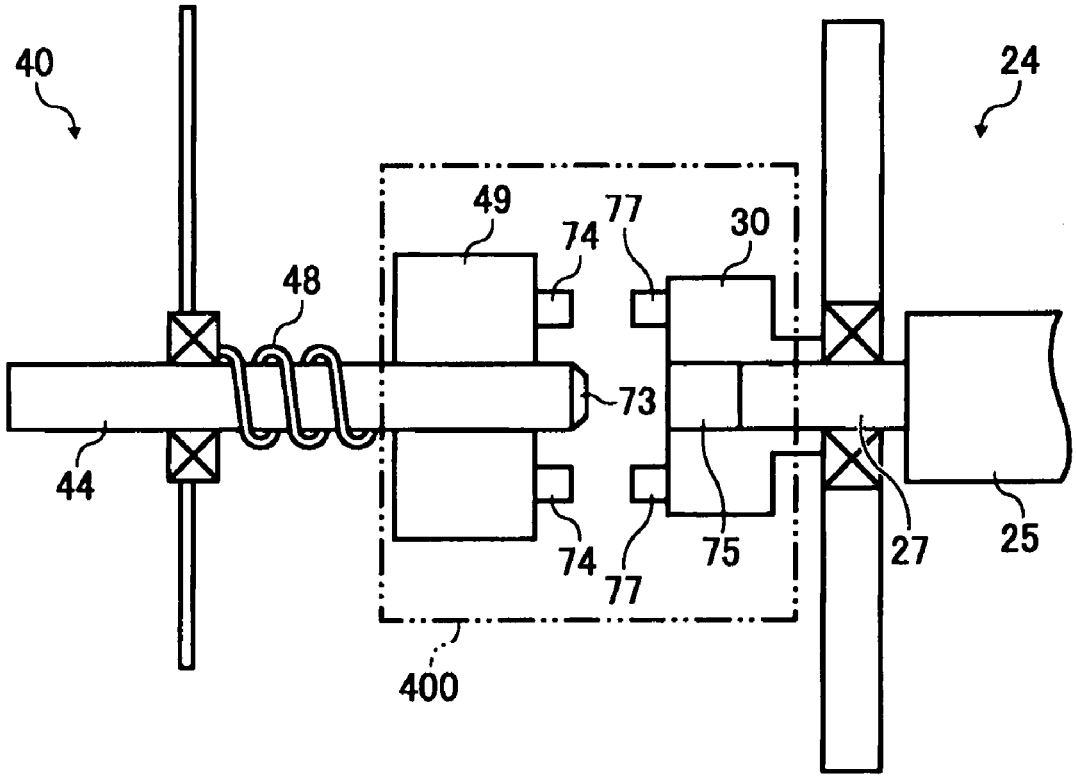
FIG. 10 is a schematic diagram illustrating (according to at least one example embodiment of the present invention) a configuration of a connecting part between the main-body-side coupling and the cartridge-side coupling.

FIG. 10 illustrates an example embodiment of a connecting part 400 between the main-body-side coupling 49 and the cartridge-side coupling 30.

In this case, as illustrated in FIG. 9B, the main-body-side coupling 49 has a cylindrical fitting convex portion 73 and two engagement convex portions 74. The cartridge-side coupling 30 has a cylindrical fitting concave portion 75 and two engagement convex portions 77.

FIG. 10 also illustrates a state in which the two engagement convex portions 74 are respectively opposed to the two engagement convex portions 77 in installing the process cartridge 24 to the apparatus main body 10 and connecting the drive shaft 44 of the driving device 40 to the developing roller shaft 27 of the developing roller 25.

Figure 11A:
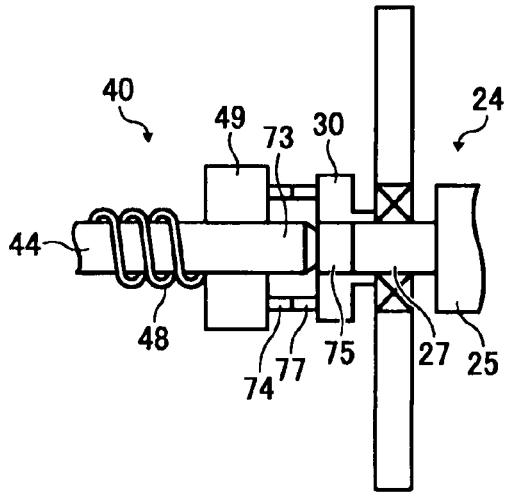
FIGS. 11A, 11B, and 11C illustrate (according to at least one example embodiment of the present invention) a connecting procedure of the main-body-side coupling and the cartridge-side coupling, when two engagement convex portions of the main-body-side coupling are respectively opposed to two engagement convex portions of the cartridge-side coupling.
Figure 11B:
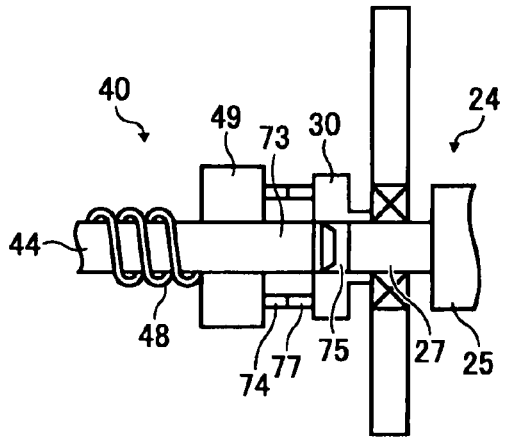
Figure 11C:
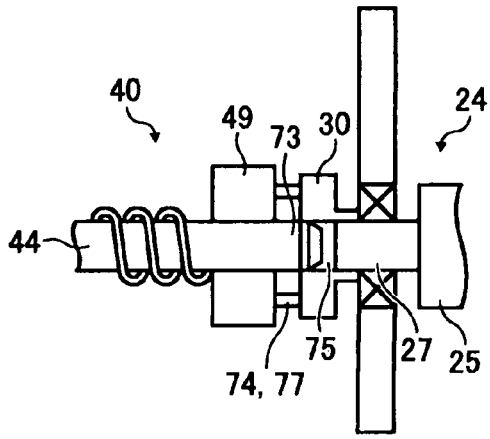

FIG. 11A, 11B, and 11C illustrate a connecting procedure of the main-body-side coupling 49 and the cartridge-side coupling 30 when the two engagement convex portions 74 are opposed to the two engagement convex portions 77.

If the two engagement convex portions 74 of the main-body-side coupling 49 are respectively opposed to the two engagement convex portions 77 of the cartridge-side coupling 30 in installing the process cartridge 24 to the apparatus main body 10, the two engagement convex portions 74 are respectively butted against the two engagement convex portions 77, as illustrated in FIG. 11A.

With the two engagement convex portions 74 and the two engagement convex portions 77 being butted against each other, the process cartridge 24 is further inserted to the apparatus main body 10. Then, as illustrated in FIG. 11B, the main-body-side coupling 49 is slid along the axial direction of the drive shaft 44, whereby the coil spring 48 is loosened.

In addition, the cylindrical fitting convex portion 73 is inserted into and is fitted with the cylindrical fitting concave portion 75. Thus, the drive shaft 44 is connected to the developing roller shaft 27 so that a positional displacement of the drive shaft 44 may be suppressed with respect to the radial direction.

Then, when the drive shaft 44 is rotated, the above butting state of the two engagement convex portions 74 and the two engagement convex portions 77 is dissolved. Further, the two engagement convex portions 74 are engaged with the two engagement convex portions 77. Thus, the drive shaft 44 is connected to the developing roller shaft 27 so as to be capable of transmitting the rotation of the drive shaft 44 to the developing roller shaft 27.

Figure 12:
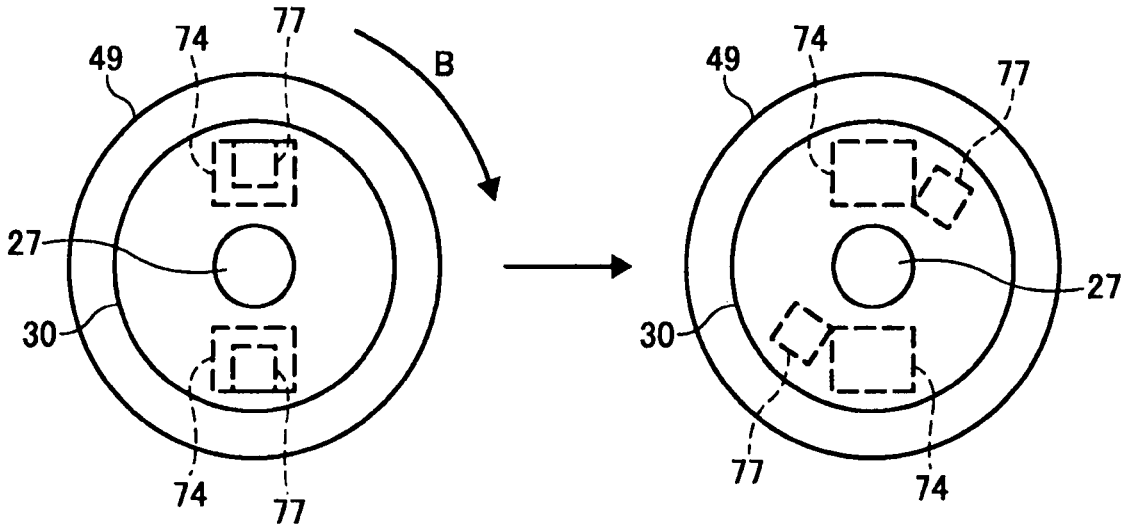
FIG. 12 illustrates (according to at least one example embodiment of the present invention) the connecting procedure illustrated in FIG. 11A, 11B, and 11C, seen from an axial direction of a developing roller shaft.

Next, referring to FIG. 12, the above connecting procedure of the main-body-side coupling 49 and the cartridge-side coupling 30 is described from a viewpoint of the axial direction of the drive shaft 44.

When the process cartridge 24 is installed to the apparatus main body 10 with the two engagement convex portions 74 being opposed to the two engagement convex portions 77, the two engagement convex portions 74 are butted against the two engagement convex portions 77.

However, when the drive shaft 44 is rotated in the direction indicated by an arrow, B, in FIG. 12, the butting state is dissolved and the two engagement convex portions 74 are respectively engaged with the two engagement convex portions 77. Thus, the drive shaft 44 is connected to the developing roller shaft 27 so as to be capable of transmitting the rotation of the drive shaft 44 to the developing roller shaft 27.

Thus, even if some conflict occur between the main-body-side coupling 49 and the cartridge-side coupling 30 at the installation of the process cartridge 24 into the apparatus main body 10, the main-body-side coupling 49 rotates so as to be relieved from the biasing force of the coil spring 48. Subsequently, the drive shaft 44 is rotated and is then connected to the developing roller shaft 27.

At this time, an operator is not required for a checking operation of the rotational positions of the main-body-side coupling 49 and the cartridge-side coupling 30. Therefore, relatively high operability may be obtained at the installation of the process cartridge 24 into the main-body-side coupling 49.

Incidentally, in the above-described example embodiments, the main-body-side coupling 49 serving as a drive joint is provided on the drive shaft 44 so as to be slidable along the axial direction thereof. The coil spring 48 is provided on the drive shaft 44 so as to serve as a biasing member that biases the main-body-side coupling 49 in one axial direction thereof.

However, the location of the biasing member is not limited to the side of the driving device 40. The cartridge-side coupling 30 serving as a driven joint may be provide on the developing roller shaft 27 so as to be slidable along the axial direction thereof. Simultaneously, the biasing member may be provided on the developing roller shaft 27 so as to bias the cartridge-side coupling 30 in one axial direction thereof.

Alternatively, the drive joint and the driven joint may be slidably mounted onto the driving side and the driven side, respectively. In addition, the drive joint and the driven joint may be biased along one axial direction by using respective biasing members.

Figure 13:
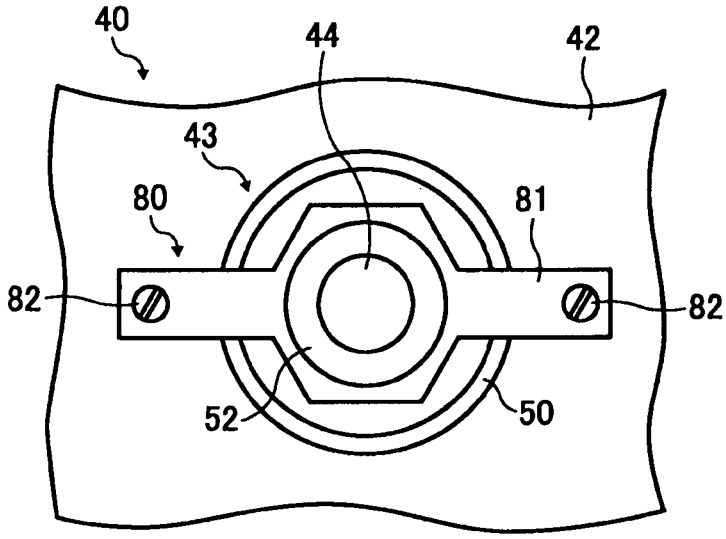
FIG. 13 is a schematic diagram illustrating (according to at least one example embodiment of the present invention) another configuration of the flexible holder provided in the driving device, seen from an axial direction of a drive shaft.

FIG. 13 illustrates another example embodiment of the flexible holder 43 provided in the driving device 40.

In FIG. 13, the flexible holder 43 includes a fixing mechanism 80 that fixes the position of the drive shaft 44 after the installation of the process cartridge 24 into the main-body-side coupling 49.

The flexible holder 43 further includes a bracket 81 that holds the ball bearing 52 of the flexible holder 43 illustrated in FIGS. 4A, 4B, and 4C. After the installation of the process cartridge 24 into the main-body-side coupling 49, both ends of the bracket 81 are fixed with screws 82 to the holding plate 42. Thus, the position of the drive shaft 44 is fixed so as suppress the runout of the drive shaft 44.

The bracket 81 has screw holes. The screw holes are formed with a sufficient margin so that the bracket 81 may be screwed with the screws 82 even if the bracket 81 is moved. Incidentally, the fixing member to fix the bracket 81 to the holding plate 42 is not limited to such a screw member. The bracket 81 may be fixed to the holding plate 42 in an electromagnetic manner.

Figure 14A:
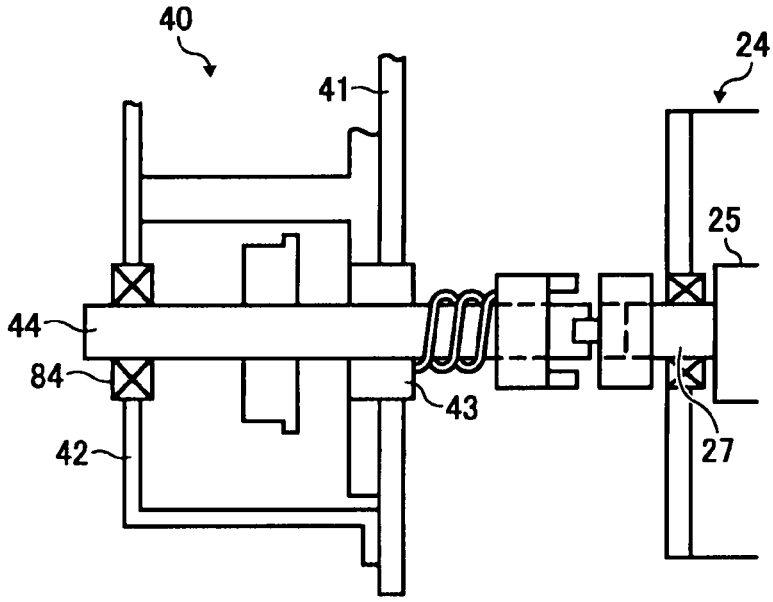
FIG. 14A is an enlarged diagram illustrating (according to at least one example embodiment of the present invention) a connected portion of the driving device on the course of connecting the developer unit thereto.
Figure 14B:
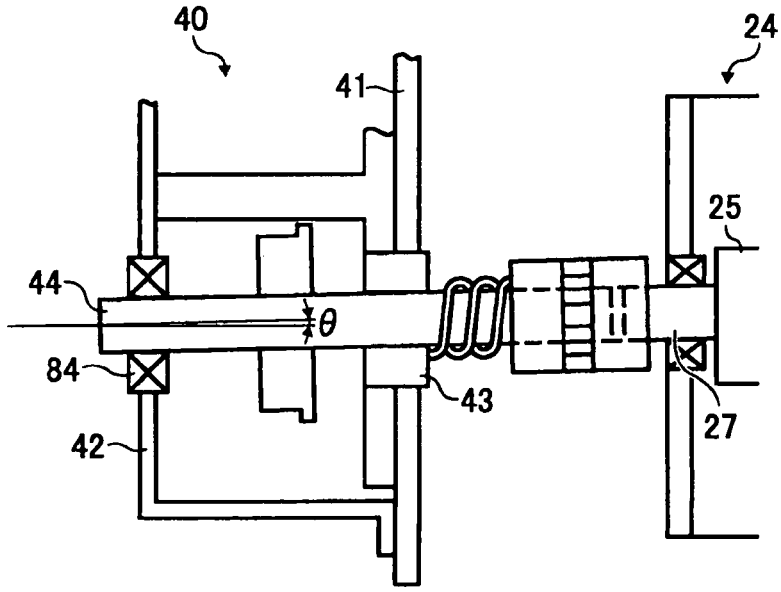
FIG. 14B is an enlarged diagram illustrating (according to at least one example embodiment of the present invention) the connected portion of the driving device of FIG. 14A after the developer unit has been connected to the driving device.

FIGS. 14A and 14B illustrate another example embodiment of the driving device 40.

In the driving device 40 illustrated in FIG. 14A, the drive shaft 44 is supported by the holding plate 42 via a bearing 84, while being supported by the main-body sideplate 41 via the flexible holder 43. The holding plate 42 is mounted on the main-body sideplate 41.

At the installation of the process cartridge 24 into the main-body-side coupling 49, as illustrated in FIG. 4B, the drive shaft 44 is positioned with respect to the radial direction by the developing roller shaft 27 and the support point of the holding plate 42. At this time, the drive shaft 44 is held at a downwardly inclined angle, θ.

Then, the support point of the drive shaft 44 is located away from the connecting point thereof with the developing roller shaft 27 so as to reduce the inclined angle, θ. Thus a rotational variation of the developing roller 25 may be reduced, thereby suppressing deterioration in image quality.

In all of the above-described example embodiments, the process cartridge 24 has the developer unit 15 as the sub unit therein, the developing roller 25 as the driven rotational member, and the developing roller shaft 27 as the driven shaft for use in positioning the driven shaft 44 with respect to the radial direction.

However, the sub unit provided in the process cartridge 24 may be the cleaner unit or the charger unit, and is not limited to the developer unit 15. Specifically, the process cartridge 24 may employ the cleaner unit as the sub unit, and a rotational cleaning member, such as a cleaning blade or a cleaning brush, as the driven rotational member. Further, the process cartridge 24 may employ a rotational center shaft of the rotational cleaning member as the driven shaft for use in positioning the drive shaft 44 with respect to the radial direction thereof.

Alternatively, the process cartridge 24 may employ the charger unit as the sub unit, and the charging roller as the driven rotational member. Further, the process cartridge 24 may employ the charging roller shaft as the driven shaft for use in positioning the drive shaft 44 with respect to the radial direction thereof.

In addition, the configuration of the process cartridge 24 is not limited to the configuration where the process cartridge 24 consists of the image carrier and only one unit from among the developer unit, the charger unit, the cleaner unit, and the like. Alternatively, the process cartridge 24 may include the image carrier and a plurality of units from among the developer unit, the charger unit, the cleaner unit, and the like.

Figure 15:
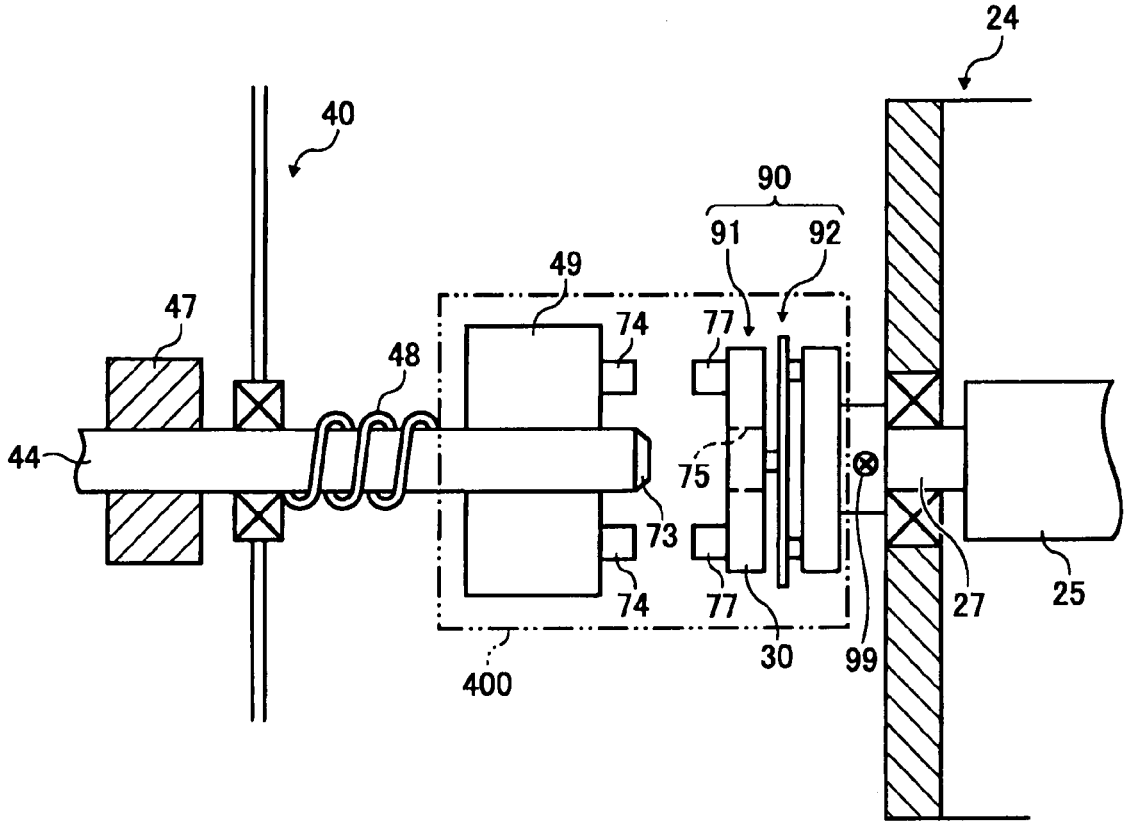
FIG. 15 is a cross-sectional diagram illustrating (according to at least one example embodiment of the present invention) another configuration of a connecting part between the main-body-side coupling and the cartridge-side coupling.
Figure 16:
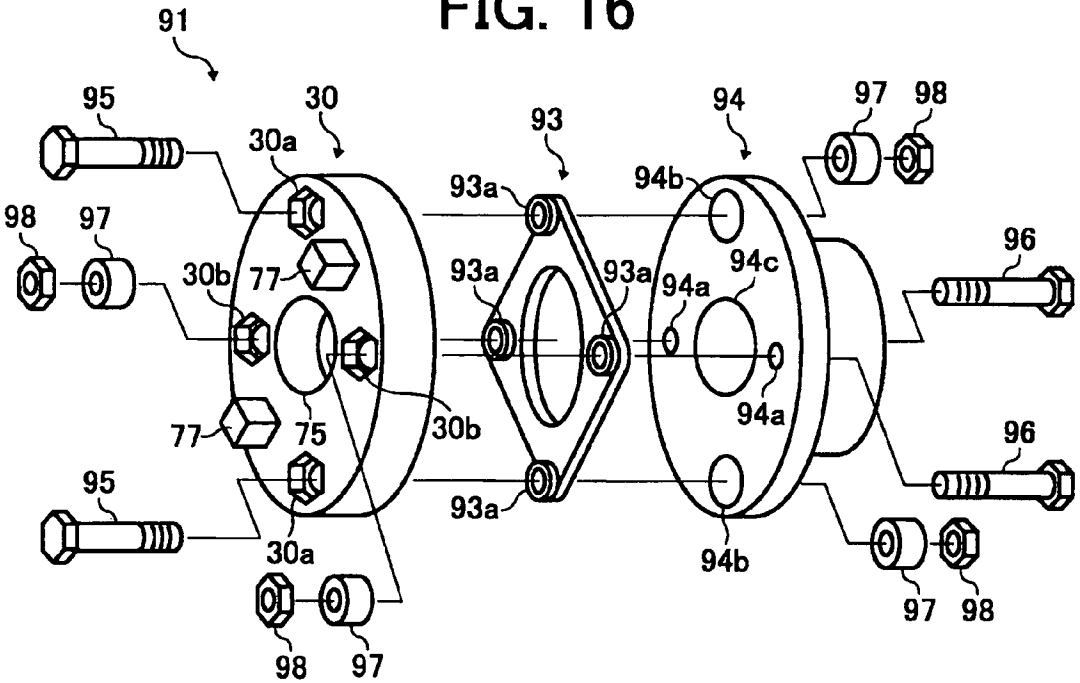
FIG. 16 is an exploded perspective diagram illustrating (according to at least one example embodiment of the present invention) a connecting mechanism, including a declination control mechanism, for use in the connecting part illustrated in FIG. 15.

FIG. 15 illustrates another example embodiment of the connecting part 400 between the drive shaft 44 of the driving device 40 and the developing roller shaft 27 of the developing roller 25.

In the above-described example embodiments, the main-body-side coupling 49 is provided on the drive shaft 44, while the cartridge-side coupling 30 is provided on the developing roller shaft 27 serving as the driven shaft. Thus, the rotation of the drive shaft 44 is transmitted to the developing roller shaft 27 via the main-body-side coupling 49 and the cartridge-side coupling 30.

However, as illustrated in FIG. 15, a connecting mechanism 90 may be provided at the connecting part 400 between the drive shaft 44 and the developing roller shaft 27. In this case, via the connecting mechanism 90, a drive force of the drive shaft 44 is transmitted to the developing roller shaft 27 so as to rotate the developing roller 25.

The connecting mechanism 90 has a joint mechanism 91 and a declination control mechanism 92. The joint mechanism 91 transmits the rotation of the drive shaft 44 to the developing roller shaft 27. In the joint mechanism 91, the drive shaft 44 and the developing roller shaft 27 are configured to be capable of engaging with and disengaging from each other.

The declination control mechanism 92 controls a declination formed between the drive shaft 44 and the developing roller shaft 27 so as to suppress a rotational variation of the drive shaft 44. Thus, the declination control mechanism 92 transmits the rotation of the drive shaft 44 to the developing roller shaft 27 so that the developing roller shaft 27 may rotate at a substantially similar speed to the drive shaft 44.

The joint mechanism 91 includes a main-body-side coupling 49 and a cartridge-side coupling 30. The main-body-side coupling 49 is fixed to the drive shaft 44 similar to the above-described example embodiments. The cartridge-side coupling 30 is provided on the developing roller shaft 27. Incidentally, the cartridge-side coupling 30 is also configured as a part of the declination control mechanism 92.

Further, the main-body-side coupling 49 has two engagement convex portions 74. On the other hand, the cartridge-side coupling 30 has two engagement convex portions 77 to be engaged with the two engagement convex portions 74.

On the other hand, the declination control mechanism 92 includes the cartridge-side coupling 30, a metal leaf 93, a flange 94, two fastening bolts 95, two fastening bolts 96, four collars 97, and four nuts 98.

The cartridge-side coupling 30 has a round shape, and is configured as a part of the joint mechanism 91. The metal leaf 93 has a square shape. The two fastening bolts 95 are inserted from the side of the cartridge-side coupling 30*b* through two opposite corners of the metal leaf 93 into the flange 94. On the other hand, the two fastening bolts 96 are inserted from the side of the flange 94 through the other two opposite corners of the metal leaf 93 into the cartridge-side coupling 30*b*.

The four collars 97 are fitted with the respective tips of the two fastening bolts 95 and the two fastening bolts 96. Further, the four nuts 98 are screwed to the respective tips of the two fastening bolts 95 and the two fastening bolts 96.

The cartridge-side coupling 30 has the engagement convex portions 77, two hexagon sockets 30*a*, and two hexagon sockets 30*b* on the outer surface thereof. The engagement convex portions 77 are engaged with the engagement convex portions 74 of the main-body-side coupling 49.

The head of the fastening bolt 95 is fitted into the hexagon socket 30*a*, while the collar 97 and the nut 98 are fitted into the hexagon socket 30*a*. In addition, the cartridge-side coupling 30*b* has an engagement concave portion 75 in the center thereof.

A circular convex portion is provided at each corner of both surfaces of the metal leaf 93. Thereby, each corner of the metal leaf 93 is configured to have an increased thickness. For each of the fastening bolts 95 and the fastening bolts 96, a through hole 93*a* is formed at the center of the corresponding circular convex portion.

The flange 94 has two through holes 94*a*, two through holes 94*b*, and a shaft hole 94*c*. The through hole 94*a* is passed through by the tip of the fastening bolt 96. On the other hand, the through hole 94*b* is passed through by the tip of the fastening bolt 95 from the side of the cartridge-side coupling 30, and is fitted with the collar 97 and the nut 98 from the side of the flange 94.

Then, an end portion of the developing roller shaft 27 is inserted into the shaft hole 94*c*, and then a screw 99 of FIG. 15 is tightened from the outer surface of the flange 94. Thus, the declination control mechanism 92 is mounted to the developing roller shaft 27.

Further, when the process cartridge 24 is inserted into the main-body-side coupling 49, the fitting convex portion 73 is inserted into the fitting concave portion 75. Thereby, a positional displacement of the drive shaft 44 may be suppressed with respect to the radial direction thereof.

Furthermore, the drive shaft 44 is rotated so as to engage the engagement convex portions 74 with the engagement convex portions 77. Thus, the drive shaft 44 is connected to the developing roller shaft 27 so as to be capable of transmitting the rotation of the drive shaft 44 to the developing roller shaft 27.

As described above, in the process cartridge 24 according to the present example embodiment, the connecting mechanism 90 including the cartridge-side coupling 30 is provided at the connecting part 400 between the drive shaft 44 of the driving device 40 and the developing roller shaft 27 of the developing roller 25. The connecting mechanism 90 absorbs a declination that may be formed between the drive shaft 44 and the developing roller shaft 27 by utilizing a flexure of the metal leaf 93. Thus, the connecting mechanism 90 transmits the rotation of the drive shaft 44 to the developing roller shaft 27 so that the developing roller shaft 27 may be rotated at a substantially similar speed to the drive shaft 44.

Therefore, according to the present example embodiment, even when a declination is formed between the drive shaft 44 and the developing roller shaft 27, the declination absorbed by the flexure of the metal leaf 93 provided on the cartridge-side coupling 30. Thus, the developing roller shaft 27 may be rotationally driven at a substantially similar speed to the drive shaft 44. Consequently, a rotational variation of the developing roller 25 may be reduced, and then degradation in image quality, such as banding and uneven density, may effectively be suppressed.

Figure 17:
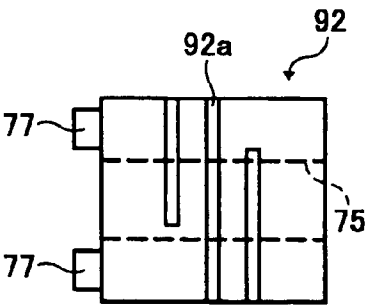
FIG. 17 illustrates (according to at least one example embodiment of the present invention) another configuration of the declination control mechanism illustrated in FIG. 16.

FIG. 17 illustrates another example embodiment of the declination control mechanism 92.

In FIG. 17, a declination control mechanism 92 is configured as a helical coupling having a cylindrical shape. The declination control mechanism 92 has a helical slit 92*a* on an outer circumferential surface thereof. The declination control mechanism 92 also has two engagement convex portions 77 on one surface thereof.

At the installation of the process cartridge 24 into the main-body-side coupling 49, the fitting convex portion 73 is inserted into the fitting concave portion 75 so as to suppress a positional displacement of the drive shaft 44 with respect to the radial direction thereof.

Then, the drive shaft 44 is rotated so as to engage the engagement convex portions 74 with the engagement convex portions 77 of the cartridge-side coupling 30. Thus, the drive shaft 44 is connected to the developing roller shaft 27 so as to be capable of transmitting the rotation of the drive shaft 44 to the drive shaft 44.

As described above, the connecting mechanism 90 including the joint mechanism 91 and the declination control mechanism 92 is provided at the connecting part 400 between the drive shaft 44 of the driving device 40 and the developing roller shaft 27 of the developing roller 25.

The declination control mechanism 92 has a helical slit on the surface thereof. The declination control mechanism 92 absorbs a declination formed between the drive shaft 44 and the developing roller shaft 27 by the deformation thereof.

The declination control mechanism 92 also transmits the rotation of the drive shaft 44 to the developing roller shaft 27 so that the developing roller shaft 27 may be rotated at a substantially similar speed to the drive shaft 44.

Therefore, according to the present example embodiment, even when a declination is formed between the drive shaft 44 and the developing roller shaft 27, the declination is absorbed by the deformation of the helical coupling. Thus, the developing roller shaft 27 may be rotationally driven at a substantially similar speed to the drive shaft 44. Consequently, a rotational variation of the developing roller 25 may be reduced, and then degradation in image quality, such as banding and uneven density, may be effectively suppressed.

Next, another example embodiment of the process cartridge support device 300 is described.

Figure 18:
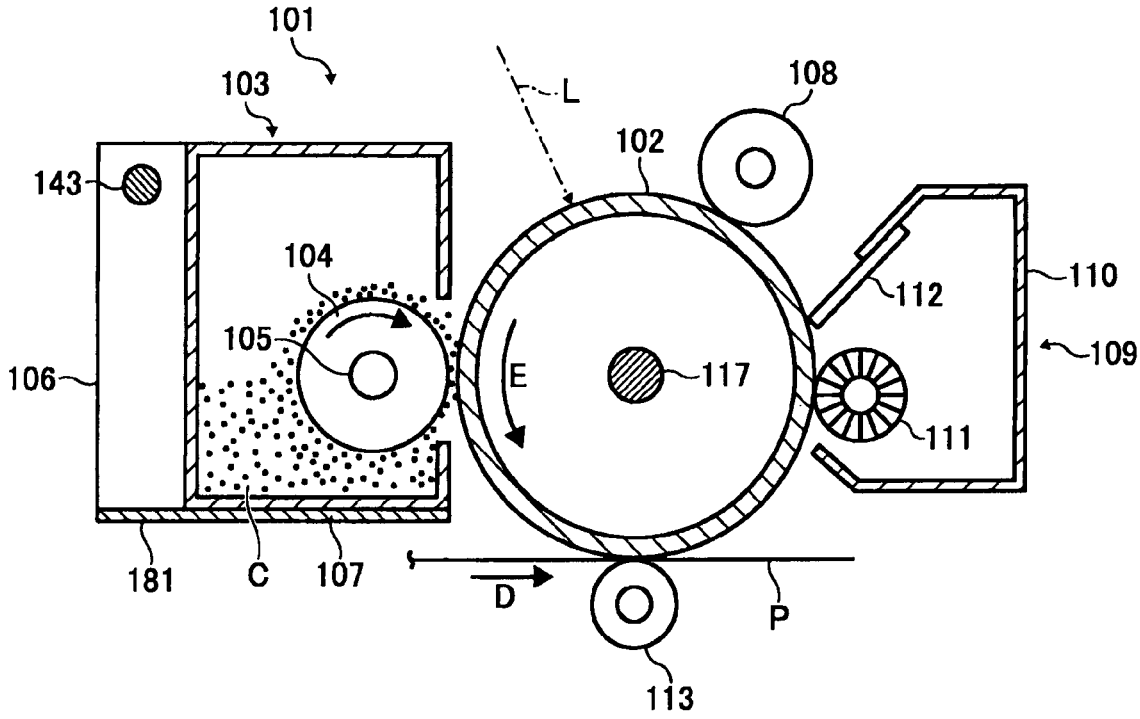
FIG. 18 is a partial diagram illustrating (according to at least one example embodiment of the present invention) an image forming apparatus employing another configuration of the process cartridge support device.

FIG. 18 illustrates a schematic configuration of an image forming apparatus 100 employing the process cartridge support device 300.

A process cartridge 101 illustrated in FIG. 18 is detachably mounted to the main body (hereinafter, "apparatus main body 114") of the image forming apparatus 100 as described later. The process cartridge 101 includes an image carrier 102 configured as a drum-shaped photoconductor. The process cartridge 101 also includes a developing roller 104 as a sub unit thereof. The image carrier 102 and the developer unit 103 are integrally provided as described later.

The developer unit 103 further includes a developing roller 104 and a unit main body 106.

The developing roller 104 is disposed so as to be opposed to the image carrier 102. The developing roller 104 also has a developing roller shaft 105, and serves as a rotational member. The developing roller shaft 105 may be integrally formed with the developing roller 104 or may be integrally connected to the developing roller 104.

The unit main body 106 positions the developing roller 104 while rotatably supporting the developing roller shaft 105 of the developing roller 104. The unit main body 106 has a developer case 107, a side plate 127, a side plate 128, and a bottom plate 181. The developer case 107 stores a dry developing agent, C.

The developer case 107 has the developing roller 104 therein. The unit main body 106 may be formed of only the developer case 107. Incidentally, the side plate 127 and the side plate 128 are described later, referring to FIG. 19.

On starting an image forming operation, the image carrier 102 is rotationally driven in the counterclockwise direction indicated by an arrow, E, in FIG. 18. At this time, the image carrier 102 is charged with a given polarity by a charging roller 108. Then, an un-illustrated optical writing unit emits light, L, on the charged surface of the image carrier 102 so as to form an electrostatic latent image thereon.

On the other hand, the developing roller 104 of the developer unit 103 is rotationally driven in a clockwise direction in FIG. 18. At this time, the developing agent, C, is carried on a surface of the developing roller 104, and is conveyed to the image carrier 102. Then, the electrostatic latent image formed on the charged surface of the image carrier 102 is visualized with the developing agent, C, as a toner image.

Meanwhile, a recording medium, P, is fed from an unillustrated sheet feeding mechanism, and is conveyed to a transfer roller 113 along the direction indicated by an arrow, D. Then, the toner image is transferred with the transfer roller 113 onto the recording medium, P.

Further, the recording medium, P, is conveyed away from the transfer position between the image carrier 102 and the transfer roller 113 to an unillustrated fuser. In the fuser, the toner image is fixed on the recording medium, P, by applying heat and pressure.

The recording medium, P, used herein is a final recording medium, such as a transfer paper sheet or a resin film. Incidentally, as described later, after the toner image formed on the image carrier 102 is temporarily transferred onto an intermediate transfer member configured as another recording medium, the toner image formed on the intermediate transfer member may be transferred onto the recording medium, P, which serves as the final recording medium.

A cleaner unit 109 cleans excess toner remaining on the image carrier 102 after the transfer of the toner image to the recording medium, P. The cleaner unit 109 illustrated in FIG. 18 has a cleaner-unit main body 110, a cleaning brush 111, and a cleaning blade 112. The cleaning brush 111 is rotatably supported with the cleaner-unit main body 110. The cleaning blade 112 is also supported by the cleaner-unit main body 110.

The above excess toner remaining on the image carrier 102 is cleaned by the cooperative action of the cleaning brush 111 and the cleaning blade 112. Incidentally, according to the present example embodiment, the cleaner-unit main body 110 is configured as a cleaner case.

Figure 19:
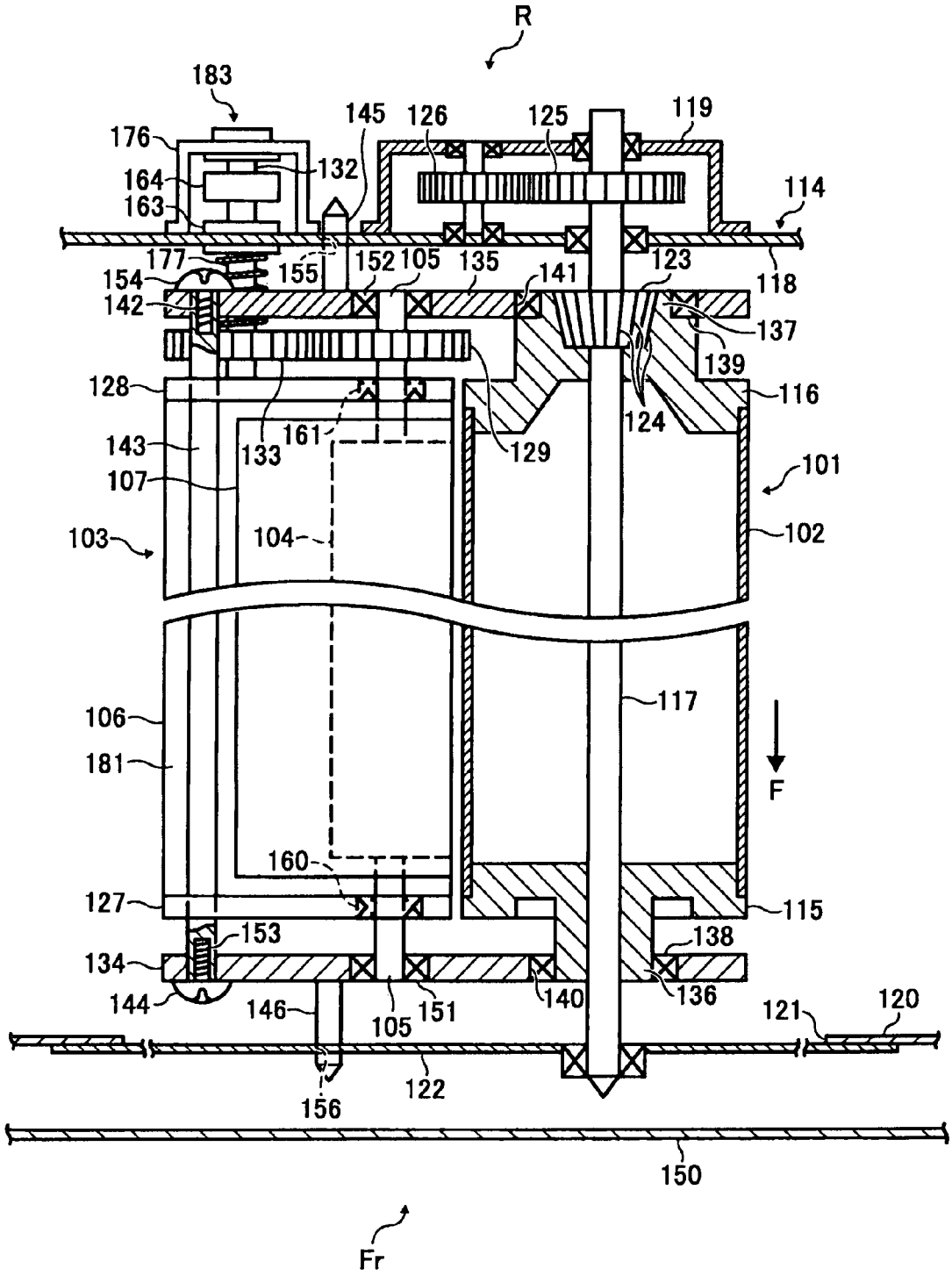
FIG. 19 is a cross-sectional plan view illustrating (according to at least one example embodiment of the present invention) a part of the process cartridge illustrated in FIG. 18.

FIG. 19 is a plan view of the process cartridge 101. In FIG. 19, a cross section is illustrated only for several units including the process cartridge 101. Incidentally, the charging roller 108 and the cleaner unit 109 illustrated in FIG. 18 are omitted from FIG. 19.

Figure 20:
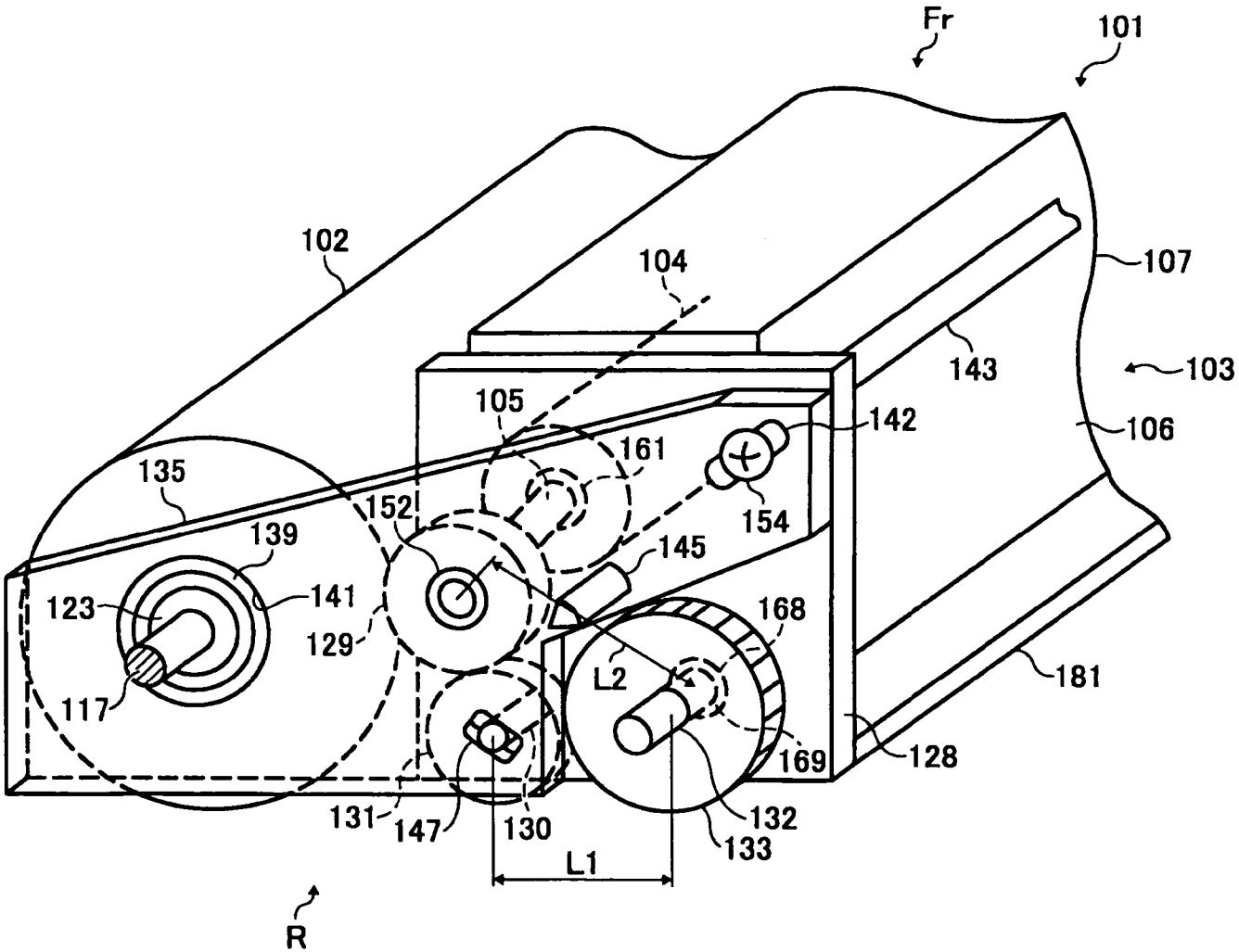
FIG. 20 is a partial perspective view illustrating (according to at least one example embodiment of the present invention) the process cartridge, seen from the rear side thereof.

In FIG. 19, a character, Fr, indicates a front side of the apparatus main body 114, while a character, R, indicates a rear side thereof. Both indications are also applied to FIGS. 20 to 25, 27 to 33. On the other hand, FIG. 20 is a perspective view of the process cartridge 101 of FIG. 19, seen from the rear side of the apparatus main body 114.

As illustrated in FIG. 19, a front flange 115 and a rear flange 116 are press-fitted at respective end portions in the longitudinal direction of the image carrier 102 having a drum shape. Further, the central holes of the front flange 115 and the rear flange 116 are passed through by end portions of a drum shaft 117. Thus, the image carrier 102 is supported by the drum shaft 117 via the front flange 115 and the rear flange 116.

The apparatus main body 114 includes an apparatus sideplate 118, a holding plate 119, an apparatus sideplate 120, and a faceplate 122. The apparatus sideplate 118 is provided at the rear side of the apparatus main body 114. The holding plate 119 is fixed to the apparatus sideplate 118. The drum shaft 117 is rotatably supported via bearings by the apparatus sideplate 118 and the holding plate 119 fixed to the apparatus sideplate 118.

On the other hand, the apparatus sideplate 120 is provided at the front side of the apparatus main body 114. The apparatus sideplate 120 has an opening 121. The opening 121 is covered with the faceplate 122.

The faceplate 122 rotatably supports a front end portion of the drum shaft 117 via a bearing. The faceplate 122 is detachably fixed to the apparatus sideplate 120 while being precisely positioned at a desired position.

The rear flange 116 has a central hole. The central hole further has a large number of teeth around the circumference thereof. An engagement member 123 having a large number of teeth 124 is fixed to the drum shaft 124 so as to be fitted with the central hole.

When the process cartridge 101 is pushed toward the rear side, R, of the apparatus main body 114 by an un-illustrated spring, the rear flange 116 is pushed toward the engagement member 123. Thus, the teeth of the central hole of the rear flange 116 and the teeth 124 of the engagement member 123 are firmly engaged with each other.

Thus, the image carrier 102 is appropriately positioned relative to the apparatus main body 114, while the image carrier 102 is detachably fixed to the drum shaft 117 via the front flange 115, the rear flange 116, and the engagement member 123. A front door 150 is provided in front of the apparatus sideplate 120 so as to be openable and closable.

The drum shaft 117 has a gear 125 that is fixed to the rear end portion thereof. The gear 125 is also engaged with a drive gear 126 that is rotatably supported by the apparatus side plate 118 and the holding plate 119. When the drive gear 126 is rotationally driven by an unillustrated motor, the rotation of the drive gear 126 is transmitted to the drum shaft 117 via the gear 125. Further, the rotation of the drum shaft 117 is transmitted to the image carrier 102 via the engagement member 123 and the rear flange 116.

Thus, the image carrier 102 is rotationally driven in the counterclockwise direction indicated by the arrow, E, in FIG. 18, and thereby the above-described image forming operation is started.

As illustrated in FIG. 19, the unit main body 106 has the side plates 127 and 128 at the front side and the rear side, respectively, thereof. The developer case 107 is integrally fixed to the side plate 127 and the side plate 128 via the bottom plate 181.

The developing roller shaft 105 of the developing roller 104 is rotatably supported by the side plates 127 and 128 via bearings 160 and 161, respectively. The developing roller shaft 105 is also positioned relative to the unit main body 106 by the side plates 127 and 128 via bearings 160 and 161, respectively.

Figure 21:
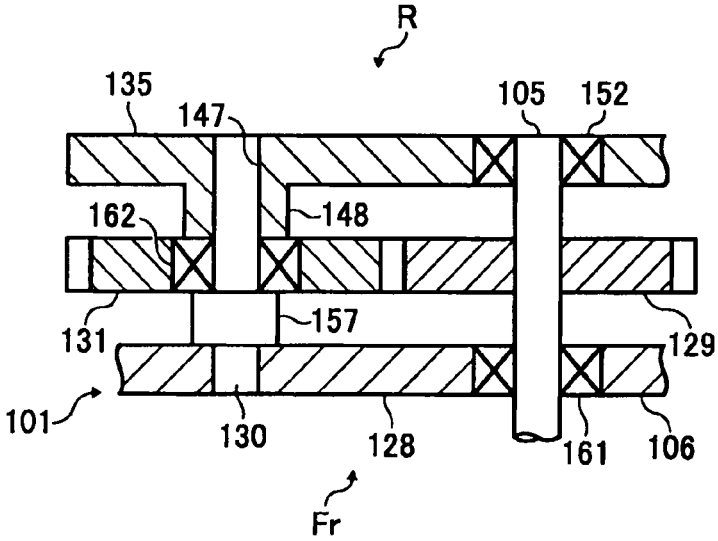
FIG. 21 is an explanatory diagram illustrating (according to at least one example embodiment of the present invention) an engagement between a roller-side gear and an idler gear.

A roller-side gear 129 is fixedly supported by the rear end portion of the developing roller shaft 105. An idler shaft 130 is fixedly positioned by the side plate 128 as illustrated in FIGS. 20 and 21. An idler gear 131 is rotatably supported by the idler shaft 130 via a bearing 162. The idler gear 131 is engaged with the roller-side gear 129.

Alternatively, the idler shaft 130 may be rotatably supported by the unit main body 106, and the idler gear 131 may be fixed on the idler shaft 130. In either case, the idler gear 131 is rotatably supported by the unit main body 106 via the idler shaft 130.

As described above, according to the present example embodiment, the sub unit of the process cartridge 101 is configured as the developer unit 103. The sub unit has the roller-side gear 129 that is supported by the developing roller shaft 105 of the developing roller 104. The sub unit also has the idler gear 131 that is rotatably supported by the unit main body 106 via the idler shaft 130.

Figure 22:
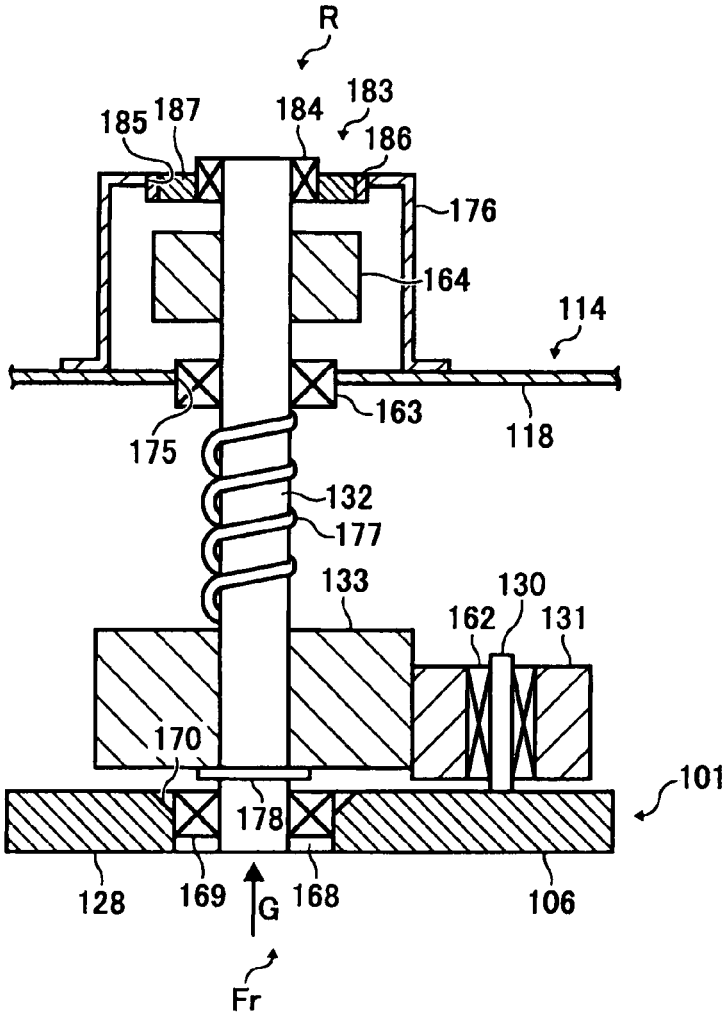
FIG. 22 is an explanatory diagram illustrating (according to at least one example embodiment of the present invention) a positional relation between a sub-unit main body and the drive shaft when the process cartridge is mounted to the main body of the image forming apparatus.

Further, as illustrated in FIGS. 19 and 22, the apparatus rear plate 118 has a guide hole 175. The guide hole 175 rotatably supports a drive shaft 132 via a bearing 163. Further, the drive shaft 132 supports a main-body-side gear 133. Thus, the drive shaft 132 is supported by the apparatus main body 114.

Furthermore, as illustrated in FIG. 20, the main-body-side gear 133 supported by the drive shaft 132 is engaged with the idler gear 131 with the process cartridge 101 being mounted on the apparatus main body 114. At this time, the main-body-side gear 133 may be integrally fixed on the drive shaft 132.

In the present example embodiment in FIG. 20, the main-body-side gear 133 is supported by the drive shaft 132 so as to be movable along the axial direction of the drive shaft 132. However, the main-body-side gear 133 is supported so as not to be relatively rotated with drive shaft 132. In this regard, a further description is given later.

As described above, in the image forming apparatus 100 of the present example embodiment, the roller-side gear 129 is drivenly connected to the main-body-side gear 133 via the single idler gear 131. On the other hand, a plurality of idler gears may be configured to be rotatably supported by the sub-unit main body. Thereby, the roller-side gear 129 may be drivenly connected to the main-body-side gear 133 via the plurality of idler gears.

Alternatively, the roller-side gear 129 may be drivenly connected to the main-body-side gear 133 directly without any idler gear. In any cases, the roller-side gear 129 is drivenly connected to the main-body-side gear 133 when the process cartridge 101 is mounted on the apparatus main body 114.

Figure 23:
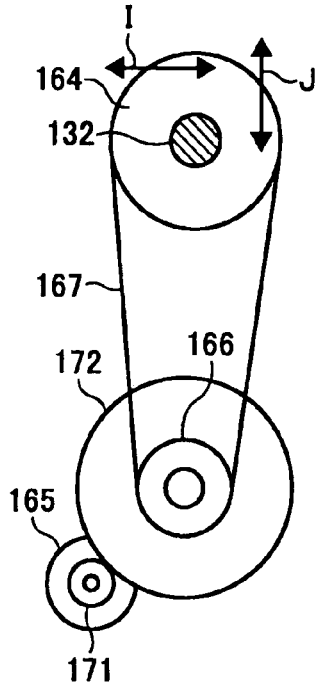
FIG. 23 is a schematic diagram illustrating (according to at least one example embodiment of the present invention) a drive transmission mechanism to transmit a drive force of a driving motor to the drive shaft.

As described above, the drive shaft 132 is rotationally driven by the driving motor disposed in the apparatus main body 114. As illustrated in FIG. 19, 22, and 23, a pulley 164 is fixed to the drive shaft 132.

Further, as illustrated in FIG. 23, a drive gear 171 is fixed to an output shaft of the driving motor 165 that is fixedly supported by the apparatus main body 114. The drive gear 171 is also engaged with a gear 172. A pulley 166 is coaxially fixed with the gear 172. A timing belt 167 is looped over the pulleys 164 and 167.

On starting an operation of the driving motor 165, a rotation of the driving motor 165 is transmitted to the drive shaft 132 via the drive gear 171, the gear 172, the pulley 166, the timing belt 167, and the pulley 164. Further, the rotation of the drive shaft 132 rotationally driven by the driving motor 165 is transmitted to the developing roller shaft 105 of the developing roller 104 via the main-body-side gear 133, the idler gear 131, and the roller-side gear 129. Subsequently, the developing roller 104 is rotationally driven in the clockwise direction in FIG. 18, and thereby the above-described developing operation is started.

Incidentally, in the case where the idler gear 131 is not provided, the main-body-side gear 133 is directly engaged with the roller-side gear 129. Thus, the rotation of the drive shaft 132 is transmitted from the main-body-side gear 133 to the roller-side gear 129.

Further, as illustrated in FIGS. 19 and 20, a faceplate 134 and a faceplate 135 are disposed at exteriors of both ends of the unit main body 106 in the longitudinal direction. The image carrier 102 and the developing roller shaft 105 are positioned relative to each other by the faceplates 134 and 135.

Specifically, ring-shaped projections 136 and 137, which are concentric with respect to the drum shaft 117, are projectingly provided at the front flange 115 and the rear flange 116, respectively. The face plates 134 and 135 have holes 140 and 141, respectively. The holes 140 and 141 are detachably fitted with the ring-shaped projections 136 and 137, respectively, via bearings 138 and 139. Further, the developing roller shaft 105 is rotatably fitted with the faceplates 134 and 135 via the bearings 138 and 139, respectively. Thereby, the image carrier 102 and the developing roller 104 are appropriately positioned.

Thus, the image carrier 102 and the sub unit configured as the developer unit 103 are integrally mounted to the apparatus main body 114. Alternatively, the image carrier 102 may be rotatably supported by the unit main body 106 of the sub unit. Thereby, the image carrier 102 and the sub unit may be integrally mounted to the apparatus main body 114.

Furthermore, the faceplate 135, which is disposed at the exterior of the rear end of the unit main body 106, has a secondary guide hole 142 formed in an oblong shape. The secondary guide hole 142 is fitted with one end of a secondary guide pin 143 that is fixed to the unit main body 106.

Similarly, as illustrated in FIG. 19, the faceplate 134, which is disposed at the exterior of the front end of the unit main body 106, has a secondary guide hole 153 formed in an oblong shape. The secondary guide hole 153 is fitted with the other end of the secondary guide pin 143.

Thus, the end portions of the secondary guide pin 143 are fitted with the secondary guide holes 142 and 153, which are formed with the faceplates 134 and 135. Thereby, the unit main body 106 is held so as not to be rotated around the central axial line of the developing roller 104.

Thus, the image carrier 102 and the developing roller 104 are connected while maintaining appropriate positions to each other to integrally form the process cartridge 101. Further, an appropriate distance is maintained between the central axial lines of the image carrier 102 and the developing roller 104.

As illustrated in FIG. 19, when the image carrier 102 and the developing roller 104 are opposed to each other with a minute gap, the minute gap is appropriately maintained. In addition, even when the image carrier 102 and the developing roller 104 are opposed in contact with each other, the contact pressure is appropriately controlled. Consequently, in either case, relatively high image quality may be obtained in the toner image formed on the image carrier 102.

Furthermore, according to the present example embodiment, the process cartridge 101 has a screw 144 and a screw 154. The screws 144 and 154 are inserted into the secondary guide holes 153 and 142, respectively, which are formed through the faceplates 134 and 135. The screws 144 and 154 are also screwed to female screws that are formed in both ends of the secondary guide pin 143. Thereby, the secondary guide pin 143 is fixed to the faceplates 134 and 135.

Thus, the unit main body 106 is fixedly connected to each of the faceplates 134 and 135, whereby a declination of the idler shaft 130 due to flexure of the unit main body 106 may be effectively suppressed. Further, a variation in the axial distance is suppressed between the idler gear 131 and each of the roller-side gear 129 and the main-body-side gear 133 engaged therewith. Therefore, unevenness in engagement between the gears may be effectively suppressed. Consequently, relatively high image quality may be obtained in the toner image formed on the image carrier 102.

Moreover, according to the present example embodiment, the process cartridge 101 employs a single pin as the secondary guide pin 143 that is fitted into each of the secondary guide holes 153 and 142. The secondary guide pin 143 is disposed so as to extend in parallel with the developing roller shaft 105 of the developing roller 104.

Thus, the front end portion of the secondary guide pin 143 is coaxially provided with the rear end portion thereof. Therefore, a variation due to the declination of the unit main body 106 may be effectively suppressed with respect to the axial distance between the idler gear 131 and the main-body-side gear 133. Consequently, relatively high image quality may be obtained in the toner image formed on the image carrier 102.

As described above, the front flange 115 and the rear flange 116, which are fixed to the image carrier 112, are fitted with the drum shaft 117. The drum shaft 117 is supportedly positioned by the apparatus main body 114. Thus, the image carrier 102 is appropriately positioned relative to the apparatus main body 114.

In addition, as illustrated in FIGS. 19 and 20, a secondary guide pin 145 is disposed on the faceplate 135 in a projecting manner to serve as a cartridge-side secondary guide fitting portion. On the other hand, a positioning hole 155 is formed through the apparatus sideplate 118 so as to serve as a main-body-side secondary guide fitting portion.

Similarly, a secondary guide pin 146 on the faceplate 135 is disposed on the faceplate 134 in a projecting manner, and a positioning hole 156 is formed through the faceplate 122.

Then, the secondary guide pin 145 is fitted into the positioning hole 155, while the secondary guide pin 146 is fitted into the positioning hole 156. Thereby, the process cartridge 101 may be held so as not to be rotated around the central axial line of the image carrier 102. In addition, the process cartridge 101 is appropriately positioned relative to the apparatus main body 114.

On detaching the process cartridge 101 from the apparatus main body 114, a front door 150 illustrated in FIG. 19 is opened, the faceplate 122 is detached from the apparatus sideplate 120, and the process cartridge 101 is pulled out toward the front side, Fr, as indicated by an arrow, F, in FIG. 19.

At this time, with the drum shaft 117 remaining in the apparatus main body 114, the idler gear 131 of the process cartridge 101 is detached from the main-body-side gear 133 that is supported by the apparatus main body 114. Then, the process cartridge 101 is pulled out to the exterior of the apparatus main body 114. Further, the faceplates 134 and 135 are detached from the image carrier 102 and the developer unit 103. Finally, the image carrier 102 and the developer unit 103 are separated from each other.

By performing the above-described detaching operation in the opposite order, the process cartridge 101 may be installed while being appropriately positioned at the desired position in the apparatus main body 114. Incidentally, an un-illustrated guide groove is formed on the process cartridge 101, while an un-illustrated guide rail is fixed on the apparatus main body 114. When the process cartridge 101 is pulled out to the front side, Fr, or is pushed toward the rear side, R, the guide groove is fitted with and is slid along the guide rail.

Furthermore, in the process cartridge 101 according to the present example embodiment, as illustrated in FIGS. 20 and 21, a free end of the idler shaft 130 is fitted with a through hole 147 formed in the faceplate 135. Thereby, the idler shaft 130 is supported by the faceplate 135.

Thus, during the rotation of the main-body-side gear 133, the idler shaft 130 is held by the faceplate 135 so that an external force transmitted from the main-body-side gear 133 to the idler gear 131 is absorbed by the faceplate 135. In addition, the idler shaft 130 is held by the faceplate 135 so as not to be bent by an external force.

Therefore, this configuration may effectively suppress a vibration of the idler shaft 130 due to the external force transmitted from the main-body-side gear 133 to the idler gear 131. This configuration may also effectively suppress unwanted banding in the toner image formed on the image carrier 102.

Alternatively, in the case where a plurality of idler gears engaged with each other are rotatably supported by the unit main body 106 via a plurality of idler shafts, the plurality of idler gears may also be supported by the faceplate. Thereby, an external force applied to each of the plurality of idler gears may be absorbed by the faceplate. Thus, high image quality may be obtained in the toner image formed on the image carrier 102.

Moreover, in the process cartridge 101 of the present example embodiment, as illustrated in FIG. 21, a base end of the idler shaft 130 is fixed to the unit main body 106, and the idler gear 131 is rotatably supported by the idler shaft 130 via the bearing 162. At this time, the idler gear 131 may be positioned by the faceplate 135 so as not to be freely moved along the axial direction.

In FIG. 21, a boss portion 148 is formed on the faceplate 135. The boss portion 148 and a flange 157 of the idler shaft 130 are disposed so as to be in contact with the bearing 162 of the idler gear 131, whereby the idler gear 131 is positioned so as not to be freely moved along the axial direction. According to this configuration, a specific member may not required for positioning the idler gear 131 along the axial direction. Therefore, the manufacturing cost of the process cartridge 101 may be reduced.

Incidentally, in the above-described image forming apparatus 100, the developing roller shaft 105 of the roller-side gear 129 and the idler shaft 130 of the idler gear 131 are supported by the unit main body 106 of the developer unit 103. On the other hand, the main-body-side gear 133 is supported by the drive shaft 132, which further supported by the apparatus main body 114.

Therefore, when only the above-described configuration is employed in the image forming apparatus 100, a variation due to accumulation of dimensional tolerances may occur with respect to a distance between the centers of the gears engaged with each other.

Specifically, when the idler gear 131 is provided as illustrated in FIGS. 20 and 21, a variation may occur with respect to a distance, L1, between the centers of the idler gear 131 and the main-body-side gear 133. Alternatively, when the idler gear 131 is not provided and the roller-side gear 129 is directly engaged with the main-body-side gear 133, a variation may occur with respect to a distance, L2, between the centers of the roller-side gear 129 and the main-body-side gear 133.

Thus, when a significant deviation from an appropriate value occurs with respect to the distance L1 or L2, the rotation may be unevenly transmitted, causing a vibration in the image carrier 102. Thus, image quality may be degraded in the toner image formed on the image carrier 102.

Accordingly, in the image forming apparatus 100 of the present example embodiment, as illustrated in FIGS. 20 and 22, a guide hole 168 is formed in the side plate 128 at the rear side of the unit main body 106. When the process cartridge 101 is mounted on the apparatus main body 114, the front end portion of the drive shaft 132 is rotatably fitted with the guide hole 168 via a bearing 169. Thus, the drive shaft 132 is positioned relative to the unit main body 106.

On the other hand, the idler shaft 130 and the developing roller shaft 105 are positioned relative to the unit main body 106 as described above. Further, even when a plurality of idler gears is provided, each idler shaft for the plurality of idler gears is appropriately positioned relative to the unit main body 106.

Thus, the drive shaft 132 supporting the main-body-side gear 133, the idler shaft 130 supporting the idler gear 131, and the developing roller shaft 105 supporting the roller-side gear 129 are commonly positioned relative to the unit main body 106. Therefore, a variation due to accumulation of dimensional tolerances may be suppressed with respect to the distance, L1, between the centers of the idler gear 131 and the main-body-side gear 133. Consequently, a relatively high dimensional accuracy may be obtained with respect to the distance, L1.

Similarly, when the idler gear 131 is employed, a relatively high dimensional accuracy may be obtained with respect to the distance, L2, between the centers of the roller-side gear 129 and the main-body-side gear 133, which are directly engaged with each other. Therefore, uneven transmission of the rotation between the gears may be effectively suppressed, and the vibration of the image carrier 102 may be reduced. Consequently, increased image quality may be obtained in the toner image formed on the image carrier 102.

Figure 24:
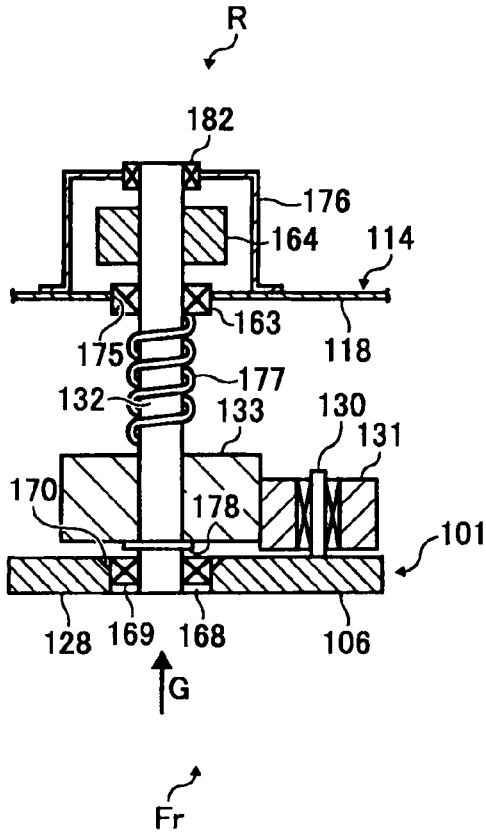
FIG. 24 is a cross-sectional view illustrating (according to at least one example embodiment of the present invention) a configuration in which the drive shaft is supported relative to the main body of the image forming apparatus at two support points.

Incidentally, as illustrated in FIGS. 19 and 22, the drive shaft 132 is rotatably supported by the apparatus sideplate 118 via the bearing 163. In order to more firmly support the drive shaft 132 relative to the apparatus main body 114, as illustrated in FIG. 24, the drive shaft 132 may also be rotatably supported via a bearing 182 by a support bracket 176 that is fixed to the apparatus sideplate 118. In this case, the drive shaft 132 is supportedly positioned at the two support points relative to the apparatus main body 114 via the bearings 163 and 182.

In this configuration, when the process cartridge 101 is not mounted on the apparatus main body 114, the drive shaft 132 may be inclined from a desired position as illustrated in FIG. 24 due to the weight thereof. Therefore, when the process cartridge 101 is pushed toward the rear side, R, of the apparatus main body 114 as indicated by an arrow, G, in FIG. 24, at the installation, the drive shaft 132 and the bearing 169 may be securely fitted into the guide hole 168 formed in the unit main body 106 of the process cartridge 101.

However, in the above configuration, when the process cartridge 101 is mounted on the apparatus main body 114, the drive shaft 132 is positioned by being fitted with the guide hole 168 of the unit main body 106 via the bearing 169. Therefore, the drive shaft 132 is supportedly positioned at the three support points.

In this case, all of the three bearings 163, 182, and 168 are difficult to be aligned with respect to the central axial lines. Therefore, a bending may occur in the drive shaft 132 supported by the three bearings 163, 182, and 168. Further, the bending may cause a rotational variation of the drive shaft 132, whereby uneven toner density may be caused in the toner image formed on the image carrier 102.

Accordingly, in the image forming apparatus 100 of the present example embodiment, as illustrated in FIG. 22, one support point of the drive shaft 132 is rotatably supported via the bearing 163 by the guide hole 175 formed in the apparatus sideplate 118. In addition, when the process cartridge 101 is mounted on the apparatus main body 114, another support point of the drive shaft 132 is rotatably fitted via the bearing 169 with the guide hole 168 formed on the unit main body 106.

Thus, one support point of the drive shaft 132 is positioned relative to the apparatus main body 114, while another support point of the drive shaft 132 is positioned relative to the process cartridge 101.

As described above, when the drive shaft 132 is supported at the two support points, the bending of the drive shaft 132 may be appropriately reduced. Consequently, the rotational variation of the drive shaft 132 may be effectively suppressed, whereby a relatively high-quality toner image may be formed on the image carrier 102. In addition, even if some eccentricity is observed between the bearings 163 and 169 that are provided at the two support points, the bending of the drive shaft 132 may be effectively suppressed.

However, in the configuration where the drive shaft 132 is supported at the two support points, when the process cartridge 101 is not mounted on the apparatus main body 114, the drive shaft 132 is supported at only one support point via the bearing 163 relative to the apparatus main body 114. Consequently, the drive shaft 132 may be significantly inclined from the desired position illustrated in FIG. 22 by the weight thereof. In this case, when the process cartridge 101 is installed to the apparatus main body 114, the drive shaft 132 is not fitted with the guide hole 168 formed in the unit main body 106.

Furthermore, when the process cartridge 101 is pushed toward the rear side as indicated by an arrow, H, in FIG. 22 at the installation, the desired position of the drive shaft 132 is indicated by a position of the drive shaft 132 obtained when the central axial line thereof is aligned with the central axial line of the guide hole 168. Therefore, when the drive shaft 132 may be significantly inclined from the desired position as described above, the drive shaft 132 is not appropriately fitted into the guide hole 168.

Accordingly, as described above with referring to FIG. 24, the drive shaft 132 is configured to be rotatably supported relative to the apparatus main body 114 at the two support points via the bearings 163 and 182. Further, when the process cartridge 101 is mounted on the apparatus main body 114, the drive shaft 132 is configured to be supported relative to the apparatus main body 114 at the three support points.

Therefore, at the installation of the process cartridge 101 to the apparatus main body 114, the drive shaft 132 is securely fitted into the guide hole 168. However, as described above, this configuration may cause a bending in the drive shaft 132, thereby resulting in a rotational variation thereof.

Accordingly, in the image forming apparatus 100 of the present example embodiment, one point of the drive shaft 132 is rotatably supported relative to the apparatus main body 114. Further, when the process cartridge 101 is mounted on the apparatus main body 114, another point of the drive shaft 132 is rotatably fitted with the guide hole 168 formed in the unit main body 106 of the sub unit. Thereby, the drive shaft 132 is appropriately positioned.

Furthermore, the apparatus main body 114 may include a flexible holder 183 to hold the drive shaft 132 so as not to be inclined from the desired position beyond a certain extent.

According to the present example embodiment, as illustrated in FIG. 22, the flexible holder 183 includes a bearing 184, a holding ring 186, and an elastic member 187. The bearing 184 is configured as a ball bearing to be fitted with the drive shaft 132. The support bracket 176 fixedly mounted on the apparatus sideplate 118 has a hole 185. The holding ring 186 is fixedly fitted with the hole 185. The elastic member 187 is formed in a ring shape and is insertedly disposed between the holding ring 186 and an outer race of the bearing 184. The elastic member 187 is made of a gel member containing soft resin, rubber, silicon rubber. Thus, the flexible holder 183 is provided in the support bracket 176 constituting a part of the apparatus main body 114. The flexible holder 183 is also disposed adjacent to an end of the drive shaft 132 on the opposite side to the side on which the process cartridge 101 is mounted, relative to the apparatus sideplate 118 of the apparatus main body 114.

As described above, before the process cartridge 101 is installed to the apparatus main body 114, the drive shaft 132 may be inclined by the weight thereof from the desired position as illustrated in FIG. 22 around the fitting portion of the drive shaft 132 with the bearing 163. Then, the elastic member 187 is elastically deformed by an external force applied from the drive shaft 132 via the bearing 184. At this time, the elastic member 187 holds the drive shaft 132 via the bearing 184 while elastically returning to the original form. Thus, a large inclination of the drive shaft 132 may be effectively suppressed.

As described above, the flexible holder 183 allows the drive shaft 132 to be inclined to some degree from the desired position. However, the flexible holder 183 holds the drive shaft 132 so as not to be inclined beyond a certain angle from the desired position.

Further, the flexible holder 183 includes the elastic member 187 to be elastically deformed by an external force applied from the drive shaft 132 and to hold the drive shaft 132 by the elasticity thereof, when the drive shaft 132 is inclined beyond a certain angle from the desired position.

When the drive shaft 132 is radially displaced, the elastic member 187 holds the drive shaft 132 by the elasticity thereof. Thus, a certain extent of radial displacement of the drive shaft 132 is tolerable, while a large amount of the radial displacement of the drive shaft 132 is effectively suppressed.

As described above, when the process cartridge 101 is not mounted on the apparatus main body 114, the drive shaft 132 is suppressed to be considerably inclined from the desired position by the flexible holder 183. Therefore, when the process cartridge 101 is pushed toward the rear side, R, of the apparatus main body 114 as indicated by the arrow, G, in FIG. 24, on the installation, the drive shaft 132 may be securely fitted into the guide hole 168 in the process cartridge 101.

Further, after the process cartridge 101 is installed to the apparatus main body 114 and further the drive shaft 132 is fitted into the guide hole 168 in the process cartridge 101, the flexible holder 183 holds the drive shaft 132 so as to be tolerable to a certain extent of radial displacement of the drive shaft 132. Therefore, unlike the case where the drive shaft 132 is supportedly positioned at the three points via the bearings, a bending of the drive shaft 132 due to a large external force may be effectively suppressed. Consequently, a rotational variation of the drive shaft 132 may be suppressed.

In addition, the flexible holder 183 also includes the elastic member 187. When an image forming operation is executed with the process cartridge 101 mounted on the apparatus main body 114, a vibration of the developing unit 103 is transmitted to the drive shaft 132. The vibration is absorbed with the elastic member 187. Thereby, the transmission of the vibration to the apparatus main body 114 may be suppressed. Thus, degradation of the image quality due to the vibration of the developer unit 103 may be effectively suppressed with respect to a toner image formed on the image carrier 102.

Incidentally, the flexible holder 183 may have the configuration illustrated in FIG. 4B or 4C, in addition to the configuration as described above.

Figure 25:
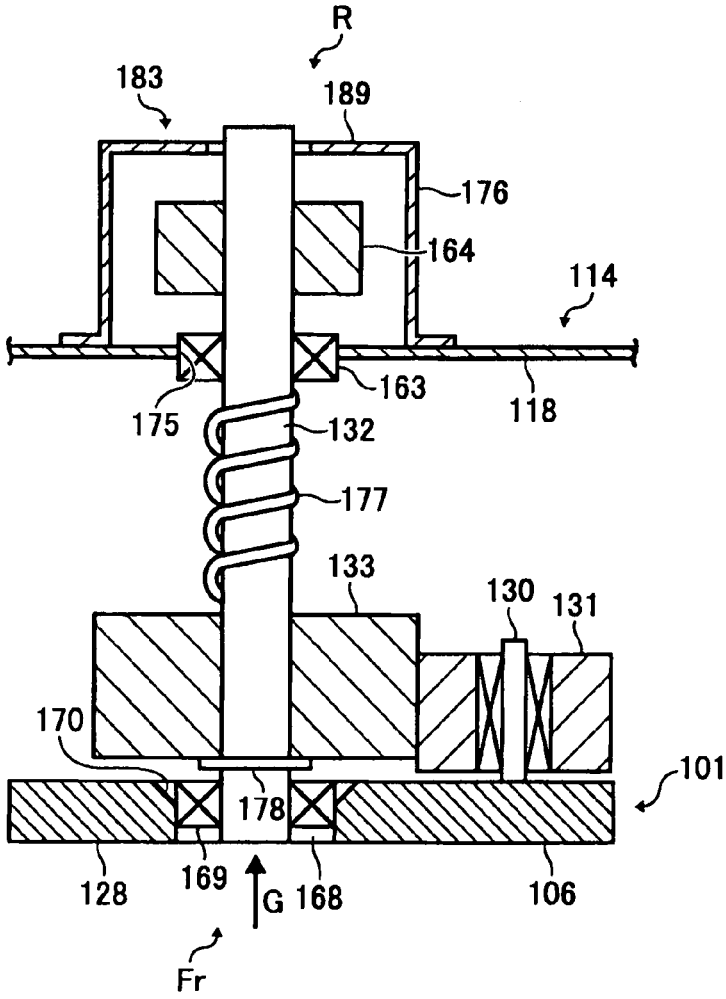
FIG. 25 is a cross-sectional view illustrating (according to at least one example embodiment of the present invention) the image forming apparatus employing another configuration of the flexible holder.

Alternatively, the flexible holder 183 may be configured as illustrated in FIG. 25. In this configuration, the support bracket 176 is fixedly mounted on the apparatus sideplate 118. Through the support bracket 176, a hole 189 is formed so as to have a slightly larger diameter than an outer diameter of the drive shaft 132.

The drive shaft 132 is fitted into the hole 189. Thus, when the process cartridge 101 is not mounted on the apparatus main body 114, the drive shaft 132 is allowed to be inclined to a certain extent from a desired position, while being held so as not to be inclined beyond the certain extent.

This configuration enables the drive shaft 132 to be securely fitted into the guide hole 168 of the process cartridge 101 when the process cartridge 101 is installed to the apparatus main body 114. In addition, after the process cartridge 101 is installed to the apparatus main body 114, the drive shaft 132 is fitted into the hole 189 having a slightly larger diameter than the drive shaft 132. Therefore, a bending of the drive shaft 132 due to an external force may be effectively suppressed.

Furthermore, in any of the above-described configurations of the flexible holder 183, the drive shaft 132 may be fixed with a fixing mechanism so as not to be inclined after the process cartridge 101 is installed to the apparatus main body 114. For example, first, when the process cartridge 101 is installed to the apparatus main body 114, the drive shaft 132 is fitted into the guide hole 168 of the process cartridge 101. Then, the drive shaft 132 is positioned by the unit main body 106 of the process cartridge 101 and the apparatus sideplate 118 of the apparatus main body 114. Further, the drive shaft 132 is fixed by using the fixing mechanism 80 as illustrated in FIG. 13.

Figure 26:
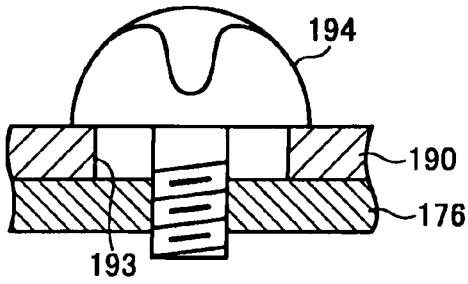
FIG. 26 is a cross-sectional view illustrating (according to at least one example embodiment of the present invention) a bracket screw provided in a fixing mechanism to suppress an inclination of the drive shaft.

Subsequently, as illustrated in FIG. 26, a screw 194 is inserted into a mounting hole 193 formed in an arm of a bracket 190 corresponding to the bracket 81 of the above-described fixing mechanism 80. The screw is screwed into a screw hole formed in the support bracket 176. By fastening the screw 194, the bearing is fixed to the support bracket 176. Thus, an inclination of the drive shaft 132 may be effectively suppressed.

In this case, as illustrated in FIG. 26, the mounting hole 193 in the bracket 190 is formed so as to have a larger diameter than an outer diameter of a shaft portion of the screw 194. Thus, the drive shaft 132 is fixed to the support bracket 176 while being appropriately positioned by the guide hole 168 of the process cartridge 101 and the guide hole 175 of the apparatus sideplate 118. Consequently, a bending of the drive shaft 132 may be effectively suppressed.

When the process cartridge 101 is detached from the apparatus main body 114 for replacement, the screw 194 is loosened prior to an installation of another process cartridge 101 so that the drive shaft 132 is allowed to be slightly inclined. Then, another process cartridge 101 is installed to the apparatus main body 114. Further, the screw 194 is fastened again so as to suppress an inclination of the drive shaft 132 together with the bracket 190.

As described above, the fixing mechanism is provided to suppress the inclination of the drive shaft 132 after the process cartridge 101 is installed to the apparatus main body 114. Therefore, even when a vibration occurs in the developer unit 103 during an image forming operation, a vibration of the drive shaft 132 is effectively suppressed. Consequently, degradation in image quality due to the vibration of the drive shaft 132 may be suppressed with respect to the toner image formed on the image carrier 102.

Alternatively, instead of fixing the bracket 190 to the support bracket 176 by the screw 194, the support bracket 176 may contain a magnetic material, and in addition un-illustrated magnets may be fixed to both arms of the bracket 190. Consequently, the attaching and detaching operations of the bracket 190 may be simplified.

Incidentally, in manufacturing the image forming apparatus, the bracket 176 may be fixed to the apparatus sideplate 118 in the following manner.

Figure 27:
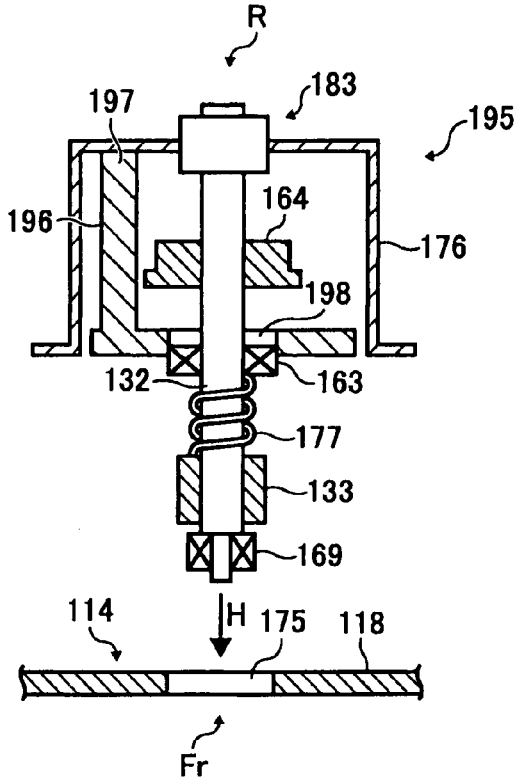
FIG. 27 is a cross-sectional view illustrating (according to at least one example embodiment of the present invention) an installation of the driving device onto the sideplate that is provided in the main body of the image forming apparatus.

As illustrated in FIG. 27, a driving device 195 has a configuration in which the drive shaft 132 is mounted to the support bracket 176 via the flexible holder 183. Further, the bearings 169 and 163, the main-body-side gear 133, the drive shaft pulley 164, and a below-described compression coil spring 177 are mounted to the drive shaft 132.

On the other hand, the guide hole 175 is formed through the apparatus sideplate 118 of the apparatus main body 114. The guide hole 175 is also formed so as to have a larger diameter than any of the outer diameters of the drive shaft 132, the bearing 169, and the compression coil spring 177.

Figure 28:
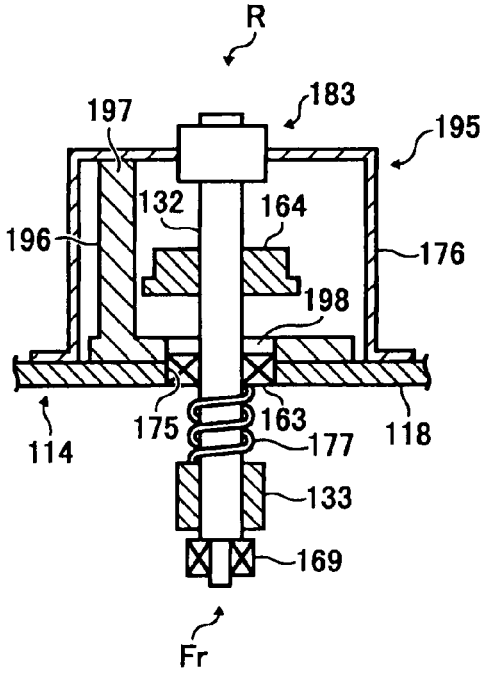
FIG. 28 is a cross-sectional view illustrating (according to at least one example embodiment of the present invention) the driving device and the sideplate after the installation of FIG. 27.

On installation, the driving device 195 is approached to the apparatus sideplate 118 of the apparatus main body 114 as indicated by an arrow, H, in FIG. 27. Then, the drive shaft 132 of the driving device 195 is inserted into the guide hole 175 formed through the apparatus sideplate 118. Further, as illustrated in FIG. 28, the bearing 163 is fitted with the guide hole 175.

Subsequently, the support bracket 176 is fixed to the apparatus sideplate 118 with an unillustrated screw. Thus, the drive shaft 132 is appropriately positioned relative to the apparatus sideplate 118, and the support bracket 176 is fixed to the apparatus sideplate 118.

During the above-described installing operation, the drive shaft 132 is held so as not to be significantly inclined from the desired position thereof. Therefore, the drive shaft 132 may be securely fitted into the guide hole 175.

Moreover, as illustrated in FIG. 27, a supplemental support member 196 may be disposed in the support bracket 176. In this case, the supplemental support member 196 contains deformable soft material, such as rubber or soft resin.

The supplemental support member 196 has a base end 197 that is fitted with the support bracket 176 by a fixing member, such as an un-illustrated screw. At this time, a portion of the bearing 163 is fitted into a hole 198 that is formed through the supplemental support member 196.

Figure 32:
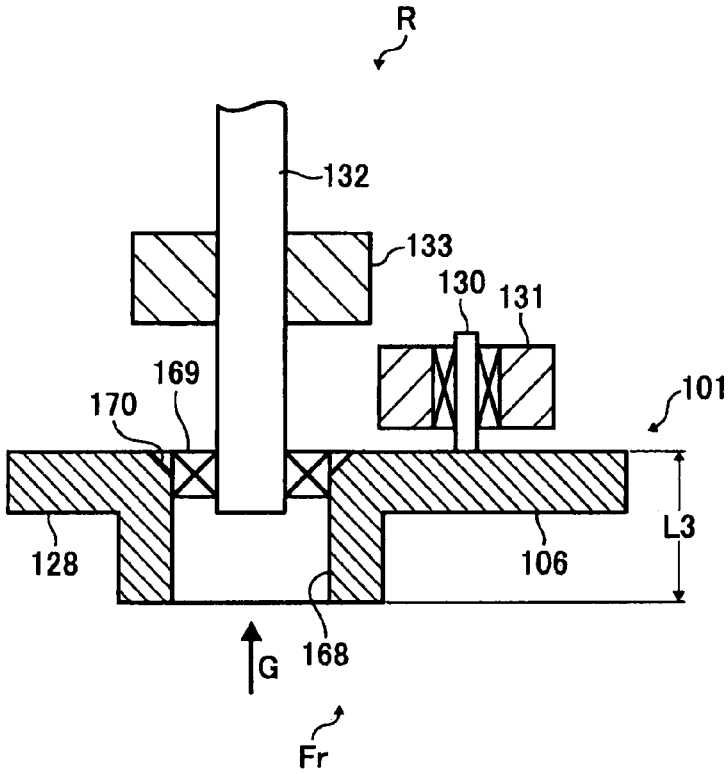
FIG. 32 is an explanatory diagram illustrating (according to at least one example embodiment of the present invention) an installation of a process cartridge having another configuration to the main body of the image forming apparatus.

The driving device 195 configured as above is mounted to the apparatus sideplate 118 in the above-described manner. Thus, the support bracket 176 may be firmly fixed to the apparatus sideplate 118 as illustrated in FIG. 32.

As described above, when the driving device 195 is configured to be mounted to the apparatus sideplate 118, the drive shaft 132 is held relative to the support bracket 176 via the bearing 163 and the supplemental support member 196 during the installation. Therefore, an inclination of the drive shaft 132 may be securely suppressed. Consequently, the drive shaft 132 may be further securely inserted into the guide hole 175.

Further, when the supplemental support member 196 is mounted on the apparatus sideplate 118, the bearing 163 is fitted with the guide hole 175 of the apparatus sideplate 118 as illustrated in FIG. 28. Thus, the drive shaft 132 is appropriately positioned relative to the apparatus sideplate 118.

On the installing operation, even when the hole 198 formed through the supplemental support member 196 does not completely match with the guide hole 175, the supplemental support member 196 containing deformable soft material is deformed, whereby the bearing 163 may be securely fitted with the guide hole 175.

In addition, when the process cartridge 101 (not illustrated in FIG. 27 and 28) is mounted on the apparatus main body 114, a bending of the drive shaft 132 due to a large external force may be effectively suppressed because the supplemental support member 196 contains deformable soft material.

Incidentally, according to the present example embodiment, the image forming apparatus 100 includes the flexible holder 183 as described above. However, as described above, the drive shaft 132 may be slightly inclined from a desired position.

Such a slight inclination of the drive shaft 132 may cause interference between the main-body-side gear 133 and the idler gear 131. Therefore, the drive shaft 132 may not be appropriately fitted into the guide hole 168 of the process cartridge 101. Accordingly, the image forming apparatus of the present example embodiment is also configured as below.

As described above, the main-body-side gear 133 is supported by the drive shaft 132 so as to be movable along the axial line direction thereof. In addition, as illustrated in FIG. 22, the compression coil spring 177 is coiled around a portion of the drive shaft 132. The main-body-side gear 133 is spring-biased by the compression coil spring 177 toward the process cartridge 101, which has been mounted on the apparatus main body 114. However, as illustrated in FIG. 22, the main-body-side gear 133 pressurized by the compression coil spring 177 is stopped by a stopper 178 that is mounted to the drive shaft 132.

Figure 29:
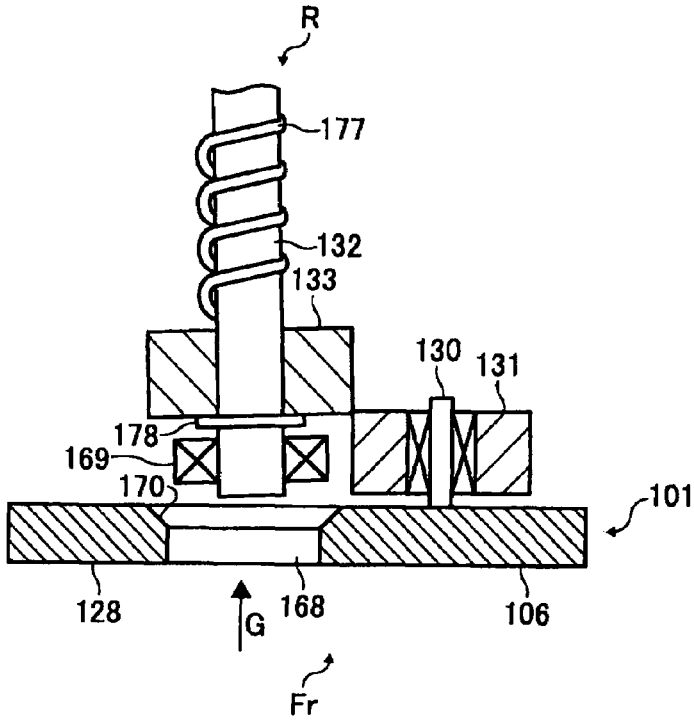
FIG. 29 is an explanatory diagram illustrating (according to at least one example embodiment of the present invention) an inclination of the drive shaft that may occur when the process cartridge is installed to the main body of the image forming apparatus.

As illustrated in FIG. 29, the process cartridge 101 is pushed along the direction indicated by the arrow, G, at the installation of the process cartridge 101 to the apparatus main body 114. At this time, the drive shaft 132 may be inclined to a certain extent centering around the bearing 163 in FIG. 22, which is press-fitted with the drive shaft 132. In this case, the idler gear 131 may come into contact with the main-body-side gear 133. However, when the process cartridge 101 is further pushed toward the rear side, R, of the apparatus main body 114, the compression coil spring 177 is compressingly deformed, whereby the main-body-side gear 133 is further moved toward the rear side, R.

Figure 30:
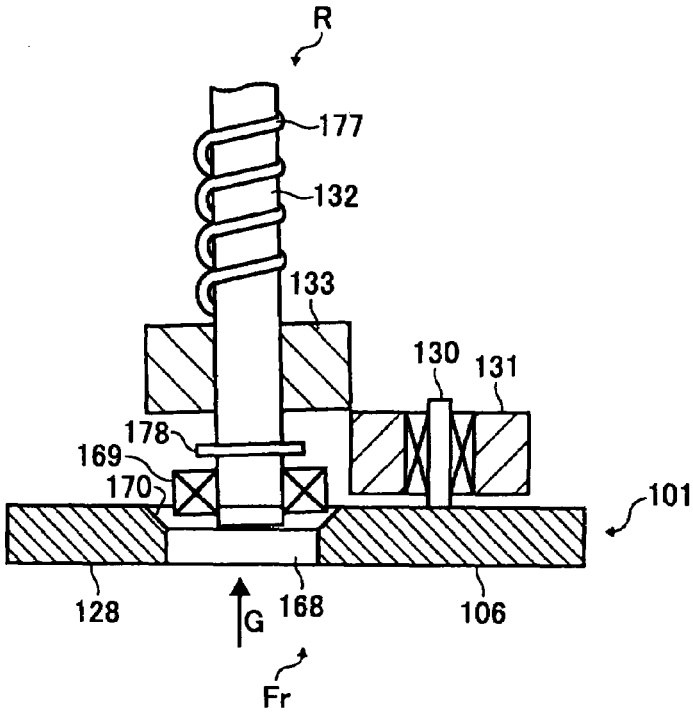
FIG. 30 is another explanatory diagram illustrating (according to at least one example embodiment of the present invention) the inclination of the drive shaft illustrated in FIG. 29.
Figure 31:
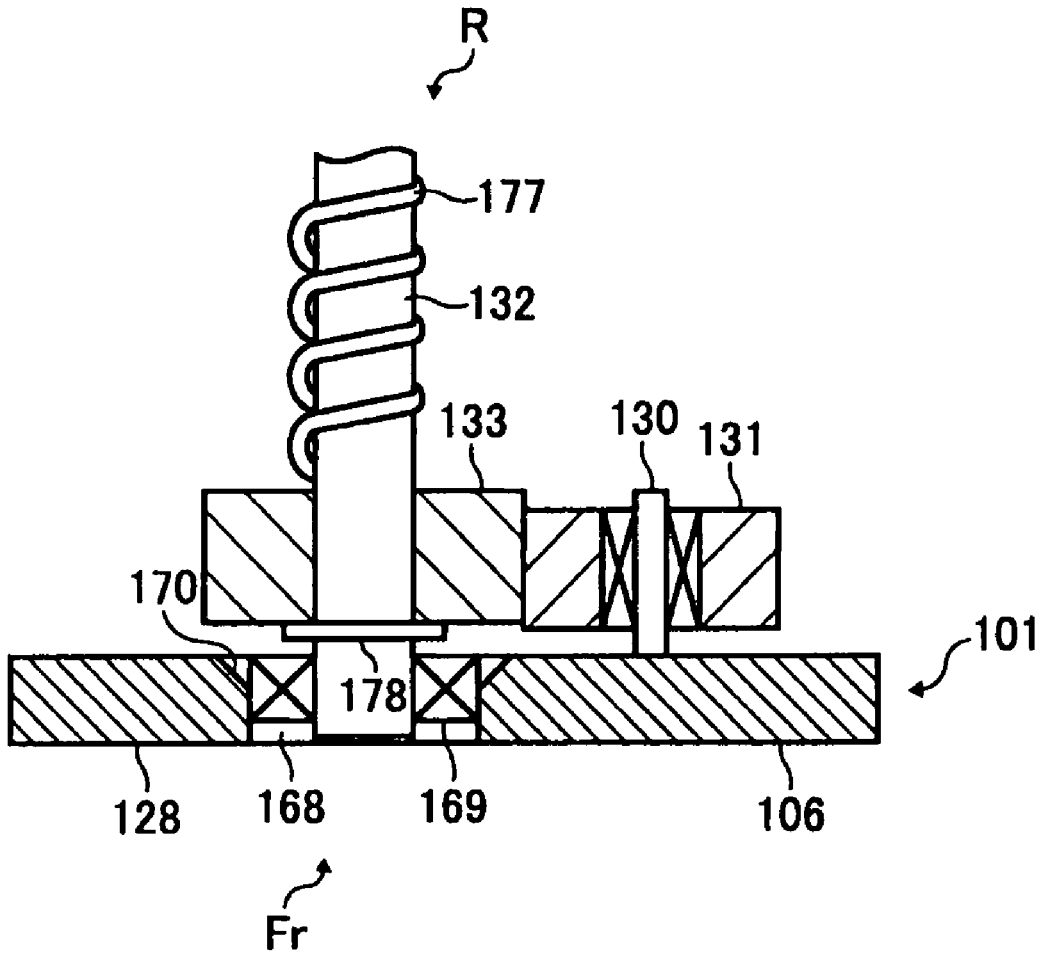
FIG. 31 is an explanatory diagram illustrating (according to at least one example embodiment of the present invention) the drive shaft illustrated in FIG. 29 after having been installed to the sideplate of the main body of the image forming apparatus.

Subsequently, as illustrated in FIG. 30, the bearing 169 is started to be fitted into the guide hole 168, which is formed in the unit main body 106. Further, as illustrated in FIG. 31, when the bearing 169 has been fitted with the guide hole 168, the drive shaft 132 is positioned so as not to be inclined from the desired position. Consequently, the interference between the main-body-side gear 133 and the idler gear 131 may be effectively controlled.

Furthermore, the main-body-side gear 133 is pushed back by the action of the compression coil spring 177. Then, the main-body-side gear 133 is moved back toward the front side, Fr, and is stopped with the stopper 178. Thus, the drive shaft 132 is securely fitted with the guide hole 168.

Figure 33:
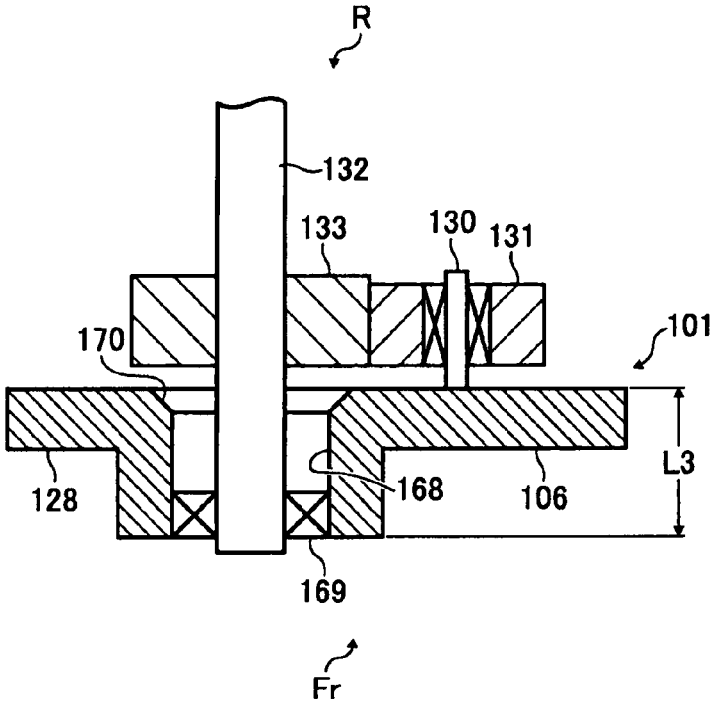
FIG. 33 is an explanatory diagram illustrating (according to at least one example embodiment of the present invention) the process cartridge illustrated in FIG. 32 after having been installed to the main body of the image forming apparatus.

Alternatively, the main-body-side gear 133 may be fixedly supported relative to the drive shaft 132. In this case, as illustrated in FIGS. 32 and 33, a length, L3, of the guide hole 168 in the unit main body 106 is preferably configured to be relatively long, compared to the above example embodiments. When the process cartridge 101 is pushed toward the rear side, R, as indicated by the arrow, G, in FIG. 27, the bearing 169 is fitted with the guide hole 168. Thereby, the inclination of the drive shaft 132 is appropriately corrected.

Thus, as illustrated in FIG. 33, the interference between the idler gear 131 and the main-body-side gear 133 is effectively controlled, whereby the drive shaft 132 is securely fitted with the guide hole 168.

As described above, according to any of the configurations illustrated in FIGS. 32 and 33, the drive shaft 132 may be securely fitted with the guide hole 168. However, since the length, L3, of the guide hole 168 is preferably configured to be relatively long, the cost and weight of the process cartridge 101 may be increased. On the other hand, the configurations as illustrated in FIGS. 22 and 31 have relative advantages with respect to the cost and weight.

As described above with referring to FIG. 23, the drive transmission mechanism 200, which transmits the drive force from the driving motor 165 to the drive shaft 132, includes the pulley 164 fixed to the drive shaft 132 and the timing belt 167 looped over the pulley 164.

For example, when the process cartridge 101 is not mounted on the apparatus main body 114, the drive shaft 132 may be slightly inclined to such a direction as indicated by an arrow, I or J in FIG. 23. At this time, the timing belt 167 may be flexibly moved corresponding to the inclination. Therefore, a breakage caused by an external large force may be effectively suppressed in the components of the drive transmission mechanism.

In the example embodiments illustrated in FIGS. 22 and 29 to 33, the guide hole 168 has a chamfer 170 on the edge side thereof close to the main-body-side gear 133. Even when the drive shaft 132 may be inclined to a certain extent at the installation of the process cartridge 101 to the apparatus main body 114, the front end of the drive shaft 132 is guided along the chamfer 170. Thus, the front end of the drive shaft 132 is securely fitted with the guide hole 168.

Further, the drive shaft 132 is fitted with the guide hole 168 via the bearing 169 mounted thereon. Therefore, when the drive shaft 132 is rotated to transmit the drive force, a sliding resistance may be effectively reduced between the drive shaft 132 and the guide hole 168, thereby increasing a transmission efficiency of the driving force.

In the above example embodiments, the process cartridge 101 includes the image carrier 102 and the developer unit 103. Alternatively, the process cartridge 101 may further include another unit. For example, when the cleaning unit 109 illustrated in FIG. 18 is included in the process cartridge 101, the cleaning unit 109 is connected to the image carrier 102.

The process cartridge 101 illustrated in FIG. 18 further includes the developing roller 104 as the rotational member, and the developer unit 103 as the rotational member unit. The process cartridge 101 is also configured to form a toner image on the image carrier 102 with the developing agent, C, which is carried by the developing roller 104.

The configuration of the process cartridge 101 is not limited to the configurations as described above. For example, the process cartridge 101 may be configured to have the cleaning brush 111 illustrated in FIG. 18 as the rotational member, and the cleaner unit 109 as the sub unit. In the process cartridge 101, the cleaning brush 111 is configured to clean excess toner remaining on the image carrier after forming a toner image thereon.

Incidentally, some conventional image forming apparatuses include a plurality of process cartridges. In each of the plurality of process cartridges, a toner image having a specific color is formed on an image carrier. The toner image may be directly transferred on a final recording medium. Alternatively, the toner image may be indirectly transferred on a final recording medium via an endless belt or a drum serving as an intermediate transfer member. The above described example embodiments in the present specification are applicable to such image forming apparatuses including a plurality of process cartridges.

Figure 34:
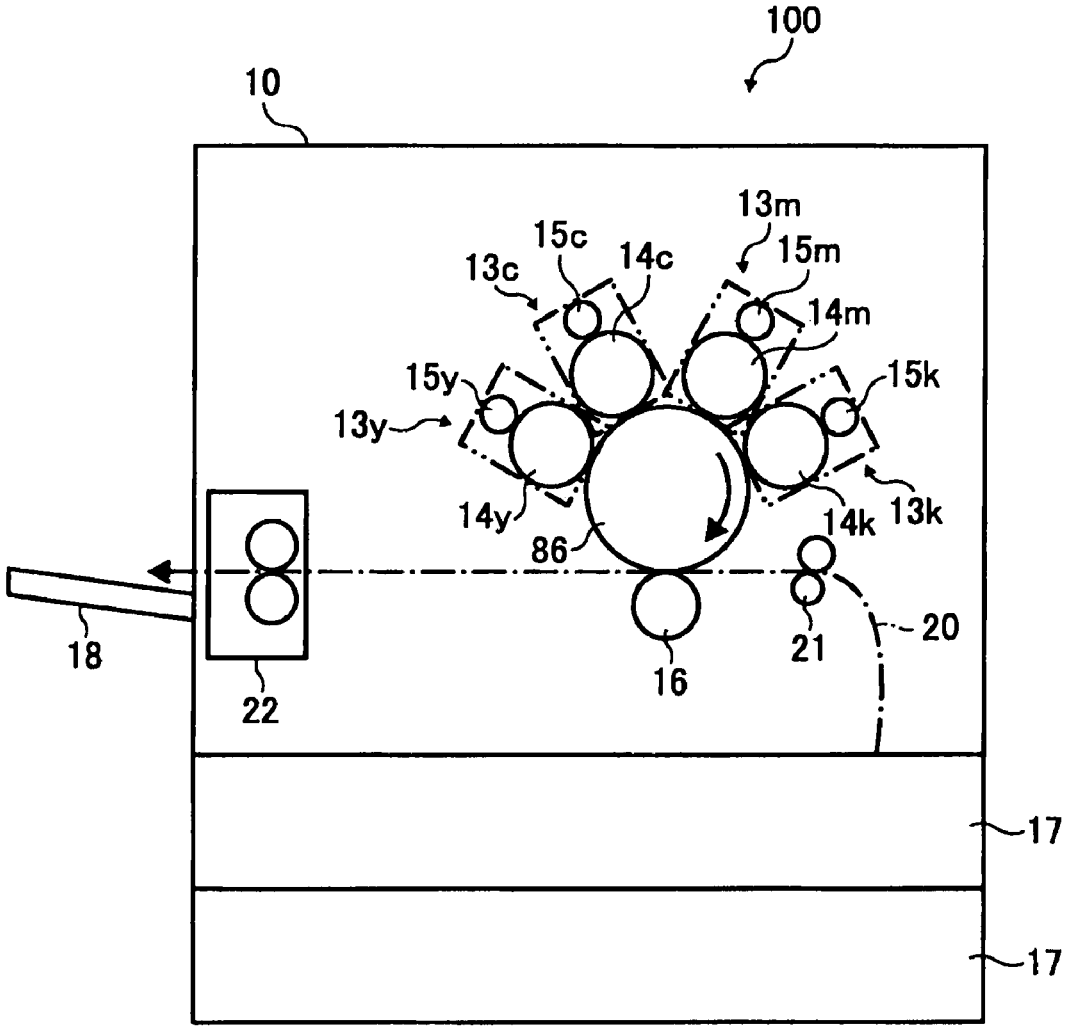
FIG. 34 is a schematic diagram illustrating another configuration of the image forming apparatus according to at least one example embodiment of the present invention.
Figure 35:
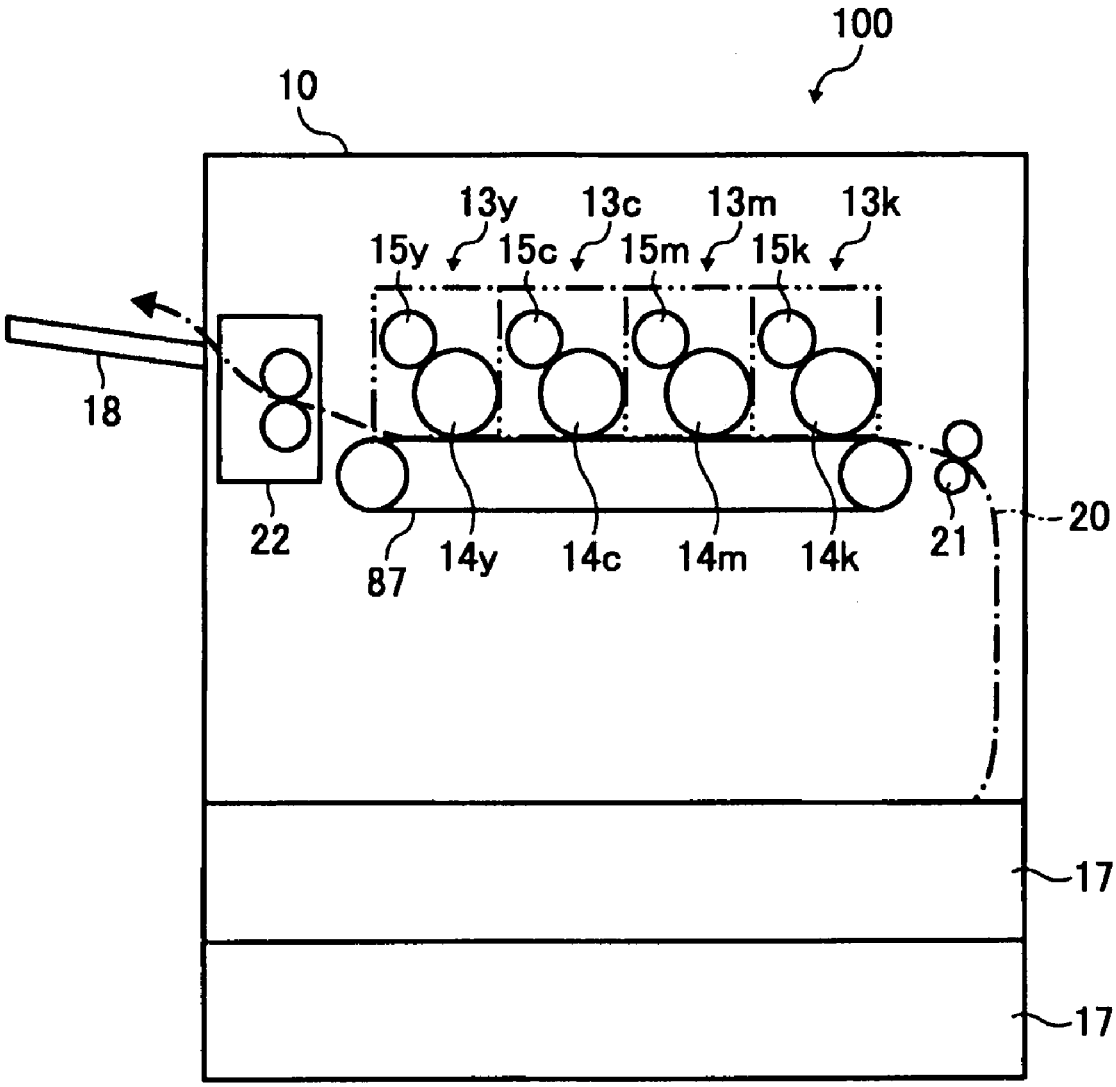
FIG. 35 is a schematic diagram illustrating another configuration of the image forming apparatus according to at least one example embodiment of the present invention.
Figure 36:
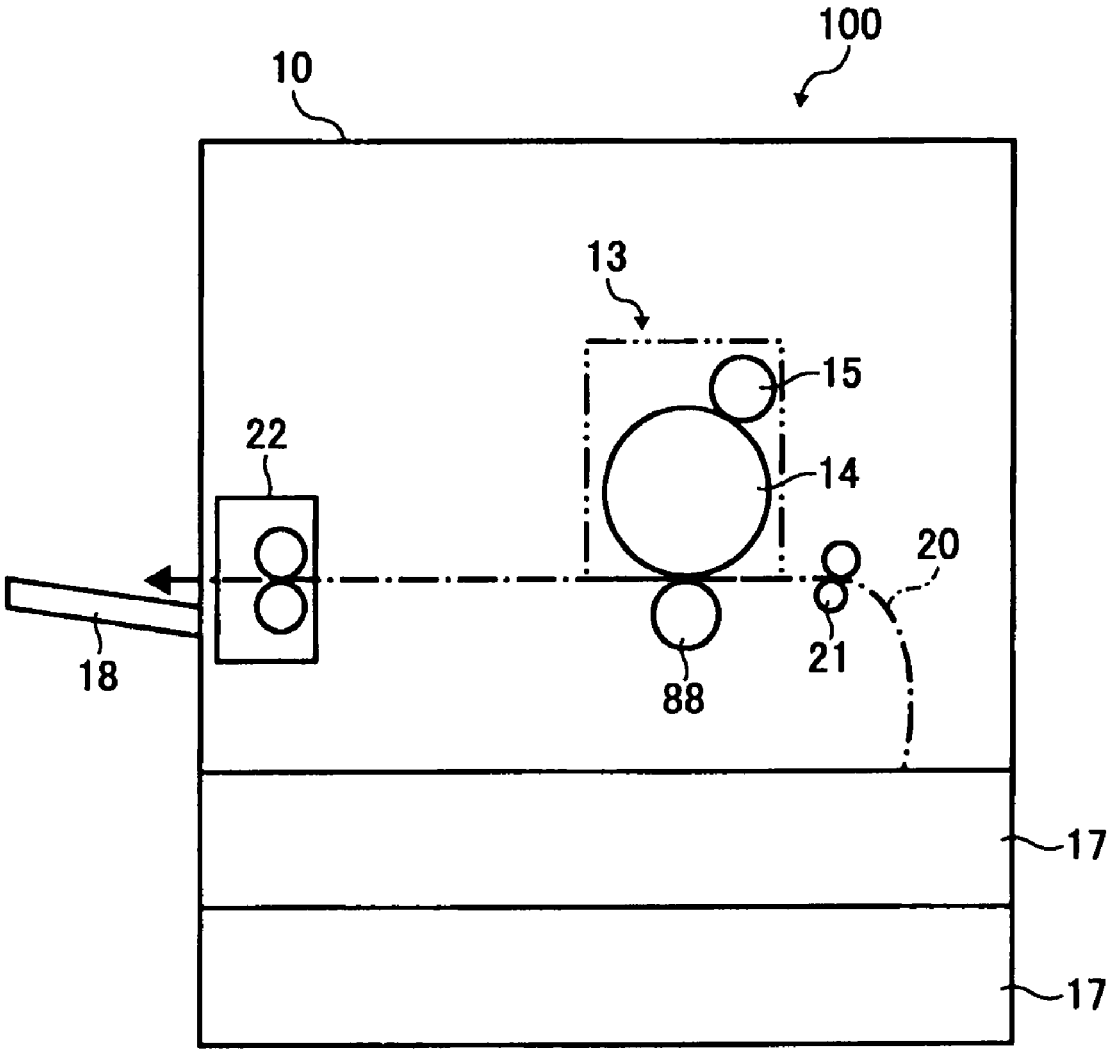
FIG. 36 is a schematic diagram illustrating another configuration of the image forming apparatus according to at least one example embodiment of the present invention.

FIGS. 34, 35, and 36 each illustrates another configuration of the image forming apparatus 100 capable of including the process cartridge support device 300 as described above. Incidentally, in FIGS. 1, 34, 35, and 36, corresponding parts are indicated by identical numbers.

The image forming apparatus 100 illustrated in FIG. 34 is configured to be a color image forming apparatus employing an intermediate transfer method. The image forming apparatus 100 includes a drum-shaped intermediate transfer member 86 , instead of the belt-shaped intermediate transfer member 12 included in the image forming apparatus 100 illustrated in FIG. 1, which is configured as a tandem-type electrophotographic color image forming apparatus.

The image forming apparatus 100 of FIG. 34 has a substantially similar configuration to the image forming apparatus of FIG. 1, except including the drum-shaped intermediate transfer member 86.

The image forming apparatus 100 illustrated in FIG. 35 is configured to be a color image forming apparatus employing a direct transfer method. As described above, in the image forming apparatus 100 illustrated in FIG. 1, a toner image formed on the photoconductor 14 is temporarily transferred on the intermediate transfer member 12, and then the toner image is transferred from the intermediate transfer member 12 to a recording medium.

On the other hand, the image forming apparatus 100 illustrated in FIG. 35 does not include the intermediate transfer medium 12. Then, the toner image formed on the photoconductor 14 is directly transferred on a recording medium, which is conveyed with a recording medium conveyance belt 87.

The image forming apparatus 100 illustrated in FIG. 36 is configured to be a monochromatic image forming apparatus employing a direct transfer method. The image forming apparatus of FIG. 36 includes one imaging station 13. The imaging station 13 further includes the process cartridge 24 according to at least one of the above-described example embodiments.

In the image forming apparatus 100 illustrated in FIG. 36, a toner image is formed on the photoconductor 14 that is provided in the process cartridge 24. Then, the toner image is transferred onto a recording medium by the transfer roller 88.

The present invention may be conveniently implemented using a conventional general purpose digital computer programmed according to the teachings of the present specification, as will be apparent to those skilled in the computer art. Appropriate software coding can readily be prepared by skilled programmers based on the teachings of the present disclosure, as will be apparent to those skilled in the software art. The present invention may also be implemented by the preparation of application specific integrated circuits or by interconnecting an appropriate network of conventional component circuits, as will be readily apparent to those skilled in the art.

Numerous additional modifications and variations are possible in light of the above teachings. It is therefore to be understood that within the scope of the appended claims, the disclosure of this patent specification may be practiced otherwise than as specifically described herein.

What is claimed is:

1. A support device for use in an image forming apparatus, the support device comprising:

a process cartridge including, an image carrier rotatably supported on a support shaft, at least one sub unit disposed proximate to the image carrier and including a rotational member, the rotational member having a driven shaft via which rotation thereof is induced, a cartridge-side fitting portion; and an apparatus main body including, an apparatus-main-body-side fitting portion to cooperate with the cartridge-side fitting portion, and a driving device having a drive shaft to rotate the driven shaft of the rotational member;

wherein the support shaft of the image carrier and the cartridge-side fitting portion locate the process cartridge on the apparatus main body so as to be detachably mounted thereon;

wherein, in the driving device, the drive shaft is supported for radial adjustment at one support point and a flexible holding point along an axial direction thereof; and wherein the drive shaft is supported with a flexible holder at the flexible holding point, which is located farther from the drive joint of the drive shaft than the one support point.

2. The support device according to claim 1, further comprising;

the drive joint at an end of the drive shaft; and a driven joint at an end of the driven shaft;

wherein a position of the drive shaft is radially adjusted by the driven shaft through a coupling between the drive joint and the driven joint.

3. The support device according to claim 2, further comprising;

a biasing member to bias at least one of the drive joint and the driven joint in one axial direction thereof;

wherein the at least one of the drive joint and the driven joint is provided in an axially slidable manner.

4. The support device according to claim 1, further comprising;

an apparatus sideplate provided in the apparatus main body, the drive shaft extending through an aperture in the apparatus sideplate at a point serving as the one support point.

5. The support device according to claim 4, further comprising;

a holding plate fixed to the apparatus sideplate, the holding plate holding the drive shaft at the point serving as the one support point.

6. The support device according to claim 4, wherein the drive shaft is radially positioned at the flexible holding point and the one support point before installing the process cartridge into the apparatus main body.

7. The support device according to claim 6, wherein the drive shaft is elastically held at the one support point.

8. The support device according to claim 6, further comprising;

a fixing member to radially fix the drive shaft after installing the process cartridge into the apparatus main body.

9. The support device according to claim 1, further comprising;

a timing belt to transmit the drive force of the driving device to the drive shaft.

10. The support device according to claim 1, wherein the image carrier is formed in a drum shape, and wherein the support shaft serves as a drum shaft of the image carrier.

11. The support device according to claim 1, wherein the sub unit is configured as a developer unit, the rotational member is configured as a developing roller, and the driven shaft is configured as a developing roller shaft.

12. The support device according to claim 1, wherein the sub unit is configured as a cleaner unit, the rotational member is configured as a cleaning member, and the driven shaft is configured as a rotation center axis of the cleaning member.

13. The support device according to claim 1, wherein the sub unit is configured as a charger unit, the rotational member is configured as a charging roller, and the driven shaft is configured as a charging roller shaft.

14. The support device according to claim 1, wherein one of the apparatus-main-body-side fitting portion and the cartridge-side fitting portion is configured as a guide pin, while the other thereof is configured as an oblong guide hole into which the guide pin is received.

15. The support device according to claim 1, further comprising;

a coupling mechanism to couple the drive shaft and the driven shaft, to absorb a declination formed between the drive shaft and the driven shaft, and so rotate the driven shaft at a substantially similar speed to the drive shaft.

16. The support device according to claim 15, wherein the coupling mechanism includes a metal leaf to absorb the declination.

17. The support device according to claim 15, wherein the coupling mechanism includes a helical slit to absorb the declination.

18. A support device for use in an image forming apparatus, the support device comprising:

a process cartridge including, an image carrier rotatably supported on a support shaft, at least one sub unit disposed proximate to the image carrier and including a rotational member and a guide hole, the rotational member having a driven shaft via which rotation thereof is induced, a cartridge-side fitting portion; and an apparatus main body including, an apparatus-main-body-side fitting portion to cooperate with the cartridge-side fitting portion, and a driving device having a drive shaft to rotate the driven shaft of the rotational member;

wherein the support shaft of the image carrier, the guide hole and the cartridge-side fitting portion locate the process cartridge on the apparatus main body so as to be detachably mounted thereon;

wherein, in the driving device, the drive shaft is supported for radial adjustment at one support point and a flexible holding point along an axial direction thereof; and wherein the drive shaft is supported with a flexible holder at the flexible holding point, which is located farther from a drive joint of the drive shaft than the one support point.

19. The support device according to claim 18, further comprising;

an apparatus sideplate provided in the apparatus main body, the drive shaft extending through an aperture in the apparatus sideplate at a point serving as the one support point.

20. The support device according to claim 19, wherein the drive shaft is radially positioned at the flexible holding point and the one support point before installing the process cartridge into the apparatus main body.

21. The support device according to claim 20, wherein the drive shaft is elastically held at the flexible holding point.

22. The support device according to claim 20, further comprising;

a fixing member to radially fix the drive shaft after installing the process cartridge into the apparatus main body.

23. The support device according to claim 18, further comprising;

a gear axially slidable on the drive shaft; and a biasing member to bias the gear toward the process cartridge.

24. The support device according to claim 18, further comprising;

a timing belt to transmit the drive force of the driving device to the drive shaft.

25. The support device according to claim 18, wherein the guide hole has a chamfer toward an exterior of the process cartridge.

26. The support device according to claim 18, further comprising;

a bearing provided to the drive shaft;

wherein the drive shaft is provided to the guide hole via the bearing.

27. The support device according to claim 18, wherein the sub unit is configured as a developer unit, the rotational member is configured as a developing roller, and the driven shaft is configured as a developing roller shaft.

28. The support device according to claim 18, wherein the sub unit is configured as a cleaner unit, the rotational member is configured as a cleaning member, and the driven shaft is configured as a rotation center axis of the cleaning member.

29. An image forming apparatus comprising:

the support device according to claim 1; and an intermediate transfer belt;

wherein an image is formed on the image carrier of the process cartridge of the support device; and wherein the image is transferred from the image carrier onto the intermediate transfer belt.

30. The image forming apparatus according to claim 29, wherein the support device comprises one of the process cartridge, and wherein the image is transferred from the intermediate transfer belt onto a recording material.

31. The image forming apparatus according to claim 29, wherein the support device comprises a plurality of the process cartridges, wherein an image is formed onto the image carrier of at least one of the plurality of the process cartridges; and wherein the image is transferred from the intermediate transfer belt onto a recording medium.

32. A method for removably mounting a process cartridge on an image forming apparatus that includes a driving device, a sub unit and a cartridge-side fitting portion, the process cartridge including an image carrier, the method comprising:

radially and adjustably positioning a drive shaft of the driving device at one support point and a flexible holding point along an axial direction of the drive shaft in the driving device;

locating a process cartridge onto a main body of the image forming apparatus by using a support shaft of the image carrier and the cartridge-side fitting portion; and coupling the drive shaft and a driven shaft of a rotational member in the sub unit, wherein the drive shaft is supported with a flexible holder at the flexible holding point, which is located farther from the drive joint of the drive shaft than the one support point.

33. The method according to claim 32, wherein the drive shaft and the driven shaft include features, respectively, that cooperate to transmit rotation of the drive shaft to the driven shaft such that the step of coupling couples for rotation.

* * * * *

UNITED STATES PATENT AND TRADEMARK OFFICE

CERTIFICATE OF CORRECTION

PATENT NO. : 7,561,826 B2
APPLICATION NO. : 11/707063
DATED : July 14, 2009
INVENTOR(S) : Junya Takigawa It is certified that error appears in the above-identified patent and that said Letters Patent is hereby corrected as shown below:

Title Page, Item (30) should read

-- Foreign Application Priority Data

| | | |
|---|---|---|
| Feb. 16, 2006 | 2006-039822 | Japan |
| Mar. 20, 2006 | 2006-076463 | Japan |
| Sep. 15, 2006 | 2006-250306 | Japan --. |

Signed and Sealed this

Twenty-second Day of December, 2009

David J. Kappos

David J. Kappos
*Director of the United States Patent and Trademark Office*